US012565994B2

(12) United States Patent
Lochschmied et al.

(10) Patent No.: US 12,565,994 B2
(45) Date of Patent: Mar. 3, 2026

(54) POWER OUTPUT DETERMINATION BY WAY OF A FUEL PARAMETER

(71) Applicant: Siemens Aktiengesellschaft, Munich (DE)

(72) Inventors: Rainer Lochschmied, Rheinstetten-Forchheim (DE); Bernd Schmiederer, Karlsruhe (DE); Harald Hauter, Sinzheim (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 599 days.

(21) Appl. No.: 17/682,006

(22) Filed: Feb. 28, 2022

(65) Prior Publication Data

US 2022/0282866 A1 Sep. 8, 2022

(30) Foreign Application Priority Data

Feb. 26, 2021 (EP) ..... 21159771
Aug. 31, 2021 (EP) ..... 21194083

(51) Int. Cl.
*F23N 1/02* (2006.01)
*F23D 14/60* (2006.01)
(Continued)

(52) U.S. Cl.
CPC ..... *F23N 1/022* (2013.01); *F23N 5/184* (2013.01); *F23N 2005/181* (2013.01);
(Continued)

(58) Field of Classification Search
CPC ..... F23D 14/60; F23K 2900/05001; F23N 1/022; F23N 1/025; F23N 2005/181;
(Continued)

(56) References Cited

U.S. PATENT DOCUMENTS 5,332,386 A * 7/1994 Hosome ..... F23N 5/082 431/12
6,486,486 B1 11/2002 Haupenthal ..... 250/554
(Continued)

FOREIGN PATENT DOCUMENTS

AT 504887 B1 * 9/2008 ..... F23N 5/242
CA 1325343 C * 12/1993 ..... G01N 33/225
(Continued)

OTHER PUBLICATIONS

Yang, Zhen et al., "Modeling Test and Study on Large Power Blast Furnace Gas Cylcone-type Burner," Boiler Technology, vol. 39, No. 1, 7 pages (Chinese w/ English abstract), Jan. 28, 2008.

*Primary Examiner* — Michael G Hoang
*Assistant Examiner* — Logan P Jones
(74) *Attorney, Agent, or Firm* — Slayden Grubert Beard PLLC

(57) ABSTRACT

Various embodiments include a method for regulating a burner appliance comprising a combustion chamber, an air supply duct with an actuator to adjust the air supply, and a fuel supply duct with a fuel actuator to adjust the fuel supply. The method comprises: determining the value of the air supply V ̇L; determining the value of an air ratio λ; providing an individual scalar fuel parameter h; calculating the power output P_ist of the appliance based on the air supply V ̇L, the air ratio λ, and the individual scalar fuel parameter h using P_ist=h/λ·V ̇L; and regulating the burner appliance with the fuel actuator and the air actuator until the actual value reaches the target value.

15 Claims, 8 Drawing Sheets

(51) Int. Cl.
*F23N 5/00* (2006.01)
*F23N 5/12* (2006.01)
*F23N 5/18* (2006.01)

(52) U.S. Cl.
CPC ..... *F23N 2235/06* (2020.01); *F23N 2235/10* (2020.01); *F23N 2235/16* (2020.01)

(58) Field of Classification Search
CPC ..... F23N 2005/185; F23N 2227/20; F23N 2233/00; F23N 2233/08; F23N 2235/06; F23N 2235/10; F23N 2235/16; F23N 5/006; F23N 5/126; F23N 5/184
See application file for complete search history.

(56) References Cited

U.S. PATENT DOCUMENTS

| | | | | |
|---|---|---|---|---|
| 7,865,276 | B2 * | 1/2011 | Skaff | B60K 6/445 701/123 |
| 10,295,182 | B2 | 5/2019 | Tulokas | |
| 10,612,472 | B2 | 4/2020 | Endo et al. | |
| 2005/0250061 | A1 | 11/2005 | Lochschmied | 431/75 |
| 2010/0286890 | A1 | 11/2010 | Chandler | 701/100 |
| 2015/0011009 | A1 | 1/2015 | Schmidt | 436/160 |
| 2015/0233578 | A1 | 8/2015 | Monteiro et al. | |

FOREIGN PATENT DOCUMENTS

| | | | | |
|---|---|---|---|---|
| CN | 1291700 | A | 4/2001 | F23N 1/02 |
| CN | 101691930 | A | 4/2010 | F23N 1/02 |
| CN | 101881224 | A | 11/2010 | F02C 9/28 |
| CN | 104583679 | A | 4/2015 | F23N 3/08 |
| CN | 106196564 | A | 12/2016 | F23N 1/02 |
| CN | 106439904 | A | 2/2017 | F23D 11/36 |
| CN | 106536898 | A | 3/2017 | F02C 9/00 |
| DE | 68909260 | T2 | 3/1994 | G01N 1/00 |
| DE | 19841475 | C1 | 2/2000 | F23N 5/08 |
| DE | 10159033 | A1 * | 9/2002 | F23N 3/082 |
| DE | 10340194 | A1 * | 4/2004 | F23N 1/022 |
| DE | 10 2006 051 883 | | 5/2008 | F23N 1/02 |
| DE | 102007059701 | A1 * | 6/2009 | F23N 1/022 |
| DE | 10 2013 106 987 | | 1/2015 | F23N 5/12 |
| EP | 0339135 | A1 | 11/1989 | F23N 1/02 |
| EP | 1091174 | A1 | 4/2001 | F23N 1/02 |
| EP | 1 467 149 | | 10/2004 | F23N 1/00 |
| EP | 2682679 | A2 | 1/2014 | F23N 5/12 |
| EP | 3296634 | A1 | 3/2018 | F23N 3/00 |
| EP | 3299718 | A1 * | 3/2018 | F23N 5/12 |
| EP | 3299718 | B1 | 3/2018 | F23N 5/12 |
| JP | 0634127 | A | 2/1994 | F23N 1/02 |
| JP | 2011064402 | A | 3/2011 | F23N 1/02 |
| WO | WO-2005116527 | A1 * | 12/2005 | B60H 1/2206 |
| WO | 2008/063549 | A2 | 5/2008 | |

* cited by examiner

POWER OUTPUT DETERMINATION BY WAY OF A FUEL PARAMETER

CROSS-REFERENCE TO RELATED APPLICATIONS

This application claims priority to EP Patent Application No. 21194083.8, filed on Aug. 31, 2021 and EP Patent Application No. 21159771.1, filed on Feb. 26, 2021. The contents of the aforesaid Patent Applications are incorporated herein for all purposes.

TECHNICAL FIELD

The present disclosure relates to burner appliances. Various embodiments of the teachings herein include methods and systems for power output determinations by way of a fuel parameter on a burner appliance. In some embodiments, there is a direct determination of a power output as a function of an air supply for a given air ratio λ.

BACKGROUND

The ratio of fuel to air is to be adjusted during the operation of a burner appliance. In this case, the following variants of the adjustment are known.

In some examples, the air actuator characteristic curve and the fuel actuator characteristic curve are determined by way of the power output during the adjustment process. For example, the determination can be performed from a small power output to a maximum power output or also conversely. In this case, the air ratio λ for each power output point is adjusted. By way of support, air supply sensors can also be used. Current air supply sensors are based on rotational speed, mass flow, differential pressure, air-volume flow etc. The absolute power output is then determined by way of a measurement of the fuel supply at at least one point or at multiple points. With the aid of the heating value $H_u$ of the fuel that is currently being fed in, the burner power output is allocated to the respective characteristic points. The power output values of the other characteristic curve points are determined by interpolation, preferably by linear interpolation.

In some examples, the air actuator characteristic curve and the fuel actuator characteristic curve are predetermined. The characteristic curves were mostly determined in the laboratory in an empirical manner. The burner power output is fixedly predetermined by a fixed function from one of the two characteristic curves. Different characteristic curves and/or sets of characteristic curves that are likewise fixedly predetermined are used for different fuels. Fundamentally, a new characteristic curve for a fuel having the calorific value $H_u$ compared to a reference characteristic curve for a fuel having the calorific value $H_{u0}$ can be calculated by multiplying by the factor $$\frac{H_{uo}}{H_u}$$

with the result that $$\dot{V}_B = \frac{H_{uo}}{H_u} \cdot \dot{V}_{B0}$$

is produced. However, the air actuator characteristic curve must be corrected where appropriate so that λ remains unchanged. In this case, the calorific value is the energy content for each fuel quantity.

In some examples, the change in a fuel composition is detected by means of a λ sensor. This can be for example an $O_2$ sensor in the exhaust gas from which λ is calculated directly. It is also possible for example to use an ionization electrode the signal of which is evaluated accordingly. In order to maintain the air ratio λ constant, either the air supply can remain unchanged or however the fuel supply can be corrected until the λ sensor again measures the original value of an air ratio λ. If the at least one air supply signal is readjusted in order to maintain the air ratio λ constant, then almost always also the power output changes with the fuel composition at this point in the characteristic curve. If the fuel supply signal is readjusted in order to maintain the air ratio λ constant, then the power output changes in dependence upon the fuel. In order to adjust the power output, it is necessary for the case of a power output correction to manually or automatically select or calculate a new characteristic curve of the air actuator.

Conventional gas types in burner facilities are such gas types from the E-gas group (in accordance with EN 437:2009-09) and gases from the B/P-gas group (in accordance with EN 437:2009-09). Gases from the E-gas group comprise as almost all gases from the second gas family (in accordance with EN 437:2009-09) methane as the main component. Gases from the B/P-gas group comprise as all gases from the third gas family (in accordance with EN 437:2009-09) propane gas as the base. The methane gas- or propane gas-based mixtures represent ultimately mixtures from different gas sources with which the burner appliance can be supplied.

In general, characteristic curves that are selected in the case of commissioning on site according to the prevailing gas group are provided for different gas types. The adjustment is performed for example by selecting one or more curves that are stored in the memory of a control unit. These characteristic curves represent the progression of the fuel quantity that is supplied to the burner with regard to the quantity of supplied air. In lieu of the quantity of supplied air, it is possible to plot the rotational speed of a blower in the air supply of the burner. Moreover, the position and/or the control signal of an air flap can be used as a measurement for the air supply.

The characteristic curves can be stored for example in tabular form with linear interpolation or however also with the aid of polynomials as a mathematical function. This form of characteristic curve allocation is disclosed in the European Patent EP3299718B1.

An air quantity is suitable as a power output value if the air temperature, air pressure or air humidity change only insignificantly or are ascertained using measurement technology. In the case of measuring the air quantity using an air mass flow sensor, the influences of air temperature and air pressure are taken into consideration. The influence of the air humidity is above all of minor importance in the case of lower temperatures.

Patent application EP2682679A2 relates to a method for regulating and/or monitoring a burner gas-operated burner. EP2682679A2 relates to the start-up of working points below and above a target air ratio. Subsequently, a signal of a mass flow sensor that is arranged in a duct between an air line and a fuel gas line is plotted. A correct or incorrect adjustment of the system is concluded from the signal.

Patent application DE102013106987A1 relates to a method and an apparatus for determining a calorific value and also a gas-operated facility having an apparatus of this type.

Patent application DE102006051883A1 relates to a facility and a method for adjusting, controlling or regulating the fuel/combustion air ratio so as to operate a burner.

Patent application EP1467149A1 relates to a method for monitoring the combustion in an incineration facility.

SUMMARY

The teachings of the present disclosure provide a direct as possible power output adjustment by way of an air supply. For example, some embodiments include a method for regulating a burner appliance (1), the burner appliance (1) comprising a combustion chamber (2), an air supply duct (11) that leads to the combustion chamber (2) and comprises at least one air actuator (3, 4) that is configured to adjust a value of an air supply $\dot{V}_L$ through the air supply duct (11), and a fuel supply duct (6) that leads to the combustion chamber (2) and comprises at least one fuel actuator (9) that is configured to adjust a value of a fuel supply $\dot{V}_B$ through the fuel supply duct (6). An example method comprises: measuring and/or predetermining a value of an air supply $\dot{V}_L$ through the air supply duct (11); measuring and/or predetermining a value of an air ratio λ; providing an individual scalar fuel parameter h; calculating an actual value Pist of a power output of the burner appliance (1) from the measured and/or predetermined value of the air supply $\dot{V}_L$, the measured and/or predetermined value of the air ratio λ and the individual scalar fuel parameter h in accordance with $P_ist=h/\lambda\cdot\dot{V}_L$; and regulating the burner appliance (1) with the aid of the at least one fuel actuator (9) and preferably of the at least one air actuator (3, 4) in dependence upon the actual value Pist of the power output of the burner appliance (1) and in dependence upon a target value Psoll of the power output of the burner appliance (1) until the target value Psoll of the power output of the burner appliance (1) is achieved.

In some embodiments, the burner appliance (1) comprises at least one air ratio sensor (20) in the combustion chamber (2) and the method further comprises: ascertaining at least one air ratio signal (21) by the at least one air ratio sensor (20) in the combustion chamber (2); and processing the at least one air ratio signal (21) to the measured value of the air ratio λ.

In some embodiments, the burner appliance (1) comprises an exhaust gas duct that leads away from the combustion chamber (2) and at least one air ratio sensor (20) in the exhaust gas duct, wherein the exhaust gas duct is different to the air supply duct (11) and different to the fuel supply duct (6), and the method further comprises: ascertaining at least one air ratio signal (21) by the at least one air ratio sensor (20) in the exhaust gas duct; and processing the at least one air ratio signal (21) to the measured value of the air ratio λ.

In some embodiments, the burner appliance 1 comprises at least one air supply sensor (12) in the or on the air supply duct (11), wherein the at least one air supply sensor (12) is in fluid connection with the air supply duct (11), and the method further comprises: ascertaining at least one air supply signal (16) by the at least one air supply sensor (12); and processing the at least one air supply signal (16) to the measured value of the air supply $\dot{V}_L$.

In some embodiments, the method further comprises: transmitting an air actuator signal to the at least one air actuator (3, 4); adjusting a value of an air supply $\dot{V}_L$ through the air supply duct (11) with the aid of the at least one air actuator (3, 4) as a function of the air actuator signal; and determining the predetermined value of the air supply $\dot{V}_L$ through the air supply duct (11) as a function of the air actuator signal and/or as a function of a rotational speed that is reported back.

In some embodiments, the burner appliance (1) comprises at least one mass flow sensor (12) that is arranged in the air supply duct (11) or is in fluid connection with the air supply duct (11); the step of ascertaining at least one air supply signal (14-16) that is a measurement for a value of the air supply $\dot{V}_L$ through the air supply duct (11) to the combustion chamber (2), said value being adjusted with the aid of the at least one air actuator (3, 4), and the method further comprises: ascertaining at least one signal (16) by the at least one mass flow sensor (12), said signal being a measurement for the value of the air supply $\dot{V}_L$ through the air supply duct (11) to the combustion chamber (2), said value being adjusted with the aid of the at least one air actuator (3, 4); and processing the at least one air supply signal (16) to the measured value of the air supply $\dot{V}_L$.

In some embodiments, the method further comprises: calculating a ratio h/λ from the individual scalar fuel parameter h and the value of the air ratio λ; and calculating an actual value Pist of a power output of the burner appliance (1) as a function of the calculated ratio h/λ and as a function of the value of the air supply $\dot{V}_L$.

In some embodiments, the method further comprises calculating an actual value Pist of a power output of the burner appliance (1) by multiplying the calculated ratio h/λ by the value of the air supply $\dot{V}_L$.

In some embodiments, the method further comprises: providing the individual scalar fuel parameter h as energy of a fuel per air volume and/or per air mass and/or per amount of substance of the air supply $\dot{V}_L$ in the case of stoichiometric portions of the fuel supply $\dot{V}_B$ and air supply $\dot{V}_L$; and calculating the ratio h/λ from the provided individual scalar fuel parameter h and the value of the air ratio λ.

In some embodiments, the burner appliance (1) comprises at least one air ratio sensor (20) and a regulating and/or controlling and/or monitoring facility (13) comprising a memory in which is stored at least one characteristic value (31, 32) comprising a minimum air requirement, and the method further comprises: ascertaining at least one air ratio signal (21) by the at least one air ratio sensor (20) and processing the at least one air ratio signal (21) to a value of an air ratio λ; ascertaining at least one air supply signal (14-16) that is a measurement for a value of the air supply $\dot{V}_L$ through the air supply duct (11) to the combustion chamber (2), said value being adjusted with the aid of the at least one air actuator (3, 4), and processing the at least one air supply signal (14-16) to a value of an air supply $\dot{V}_L$; ascertaining at least one fuel supply signal (17-19) that is a measurement for a value of a fuel supply $\dot{V}_B$ through the fuel supply duct (6) to the combustion chamber (2), said value being adjusted with the aid of the at least one fuel actuator (9), and processing the at least one fuel supply signal (17-19) to a value of a fuel supply $\dot{V}_B$; calculating a minimum air requirement (22) as a function of the value of the air supply $\dot{V}_L$ and as a function of the value of the fuel supply $\dot{V}_B$ and as a function of the value of the air ratio λ; comparing the calculated minimum air requirement (22) with the minimum air requirement of the at least one characteristic value (31, 32) that is stored in the memory of the regulating and/or controlling and/or monitoring facility (13); allocating a fuel group from the comparison of the calculated minimum air requirement (22) with the minimum air requirement of the at least one characteristic value (31, 32) that is stored in the memory of the regulating and/or controlling and/or monitoring facility (13); and providing the individual scalar fuel parameter h as a function of the allocated fuel group.

In some embodiments, the air supply duct (11) leads directly to the combustion chamber (2) and the fuel supply duct (6) leads directly to the combustion chamber (2), and the method further comprises: ascertaining at least one air supply signal (14-16) that is a measurement for a value of the air supply $\dot{V}_L$ through the air supply duct (11) directly to the combustion chamber (2), said value being adjusted with the aid of the at least one air actuator (3, 4), and processing the at least one air supply signal (14-16) to a value of the air supply $\dot{V}_L$; and ascertaining at least one fuel supply signal (17-19) that is a measurement for a value of a fuel supply $\dot{V}_B$ through the fuel supply duct (6) directly to the combustion chamber (2), said value being adjusted with the aid of the at least one fuel actuator (9), and processing the at least one fuel supply signal (17-19) to a value of the fuel supply $\dot{V}_B$.

In some embodiments, the air supply duct (11) and the fuel supply duct (6) issue upstream of the combustion chamber (2) into a common mixture feed that leads to the combustion chamber (2), and the method further comprises: ascertaining at least one air supply signal (14-16) that is a measurement for a value of the air supply $\dot{V}_L$ through the air supply duct (11) to the common mixture feed, said value being adjusted with the aid of the at least one air actuator (3, 4), and processing the at least one air supply signal (14-16) to a value of the air supply $\dot{V}_L$; and ascertaining at least one fuel supply signal (17-19) that is a measurement for a value of a fuel supply $\dot{V}_B$ through the fuel supply duct (6) to the common mixture feed, said value being adjusted with the aid of the at least one fuel actuator (9), and processing the at least one fuel supply signal (17-19) to a value of the fuel supply $\dot{V}_B$.

In some embodiments, the at least one characteristic value (31, 32) that is stored in the memory of the regulating and/or controlling and/or monitoring facility (13) comprises the minimum air requirement in the form of a limit value (31, 32); the limit value (31, 32) delimits values of the minimum air requirement of a first and a second fuel group from one another; and the method further comprises allocating the calculated minimum air requirement (22) to the first or to the second fuel group with the aid of the limit value (31, 32) of the at least one characteristic value (31, 32) that is stored in the regulating and/or controlling and/or monitoring facility (13).

In some embodiments, calculating the minimum air requirement as a function of the value of the air supply $\dot{V}_L$ and as a function of the value of the fuel supply $\dot{V}_B$ and as a function of the value of the air ratio λ comprises calculating the minimum air requirement as a quotient from the value of the air supply $\dot{V}_L$ and a product from the value of the fuel supply $\dot{V}_B$ and from the value of the air ratio λ.

As another example, some embodiments include a computer program product comprising commands that in the case of implementing the program by a regulating and/or controlling and/or monitoring facility (13) for a burner appliance (1) comprising at least one fuel actuator (9) and at least one air actuator (3, 4) cause the regulating and/or controlling and/or monitoring facility (13): to calculate an actual value Pist of a power output of the burner appliance (1) from a measured and/or predetermined value of the air supply $\dot{V}_L$, a measured and/or predetermined value of the air ratio λ and an individual scalar fuel parameter h in accordance with $P_ist=h/\lambda\cdot\dot{V}_L$; and to regulate the burner appliance (1) with the aid of the at least one fuel actuator (9) and of the at least one air actuator (3, 4) in dependence upon the actual value Pist of the power output of the burner appliance (1) and in dependence upon a target value Psoll of the power output of the burner appliance (1) until the target value Psoll of the power output of the burner appliance (1) is achieved.

As another example, some embodiments include a non-volatile computer-readable memory storage medium that stores a set of commands for implementation by at least one regulating and/or controlling and/or monitoring facility (13) for a burner appliance (1), the burner appliance (1) comprising at least one fuel actuator (9) and at least one air actuator (3, 4), which if the set of commands is implemented by the regulating and/or controlling and/or monitoring facility (13): calculates an actual value Pist of a power output of the burner appliance (1) from a measured and/or predetermined value of the air supply $\dot{V}_L$, a measured and/or predetermined value of the air ratio λ and an individual scalar fuel parameter h in accordance with $P_ist=h/\lambda\cdot\dot{V}_L$; and regulates the burner appliance (1) with the aid of the at least one fuel actuator (9) and of the at least one air actuator (3, 4) in dependence upon the actual value Pist of the power output of the burner appliance (1) and in dependence upon a target value Psoll of the power output of the burner appliance (1) until the target value Psoll of the power output of the burner appliance (1) is achieved.

BRIEF DESCRIPTION OF THE DRAWINGS

Various details are accessible to the person skilled in the art with the aid of the following detailed description. The individual embodiments are not limited thereby. The drawings which are attached to the description can be described as follows.

DETAILED DESCRIPTION

Figure 1:
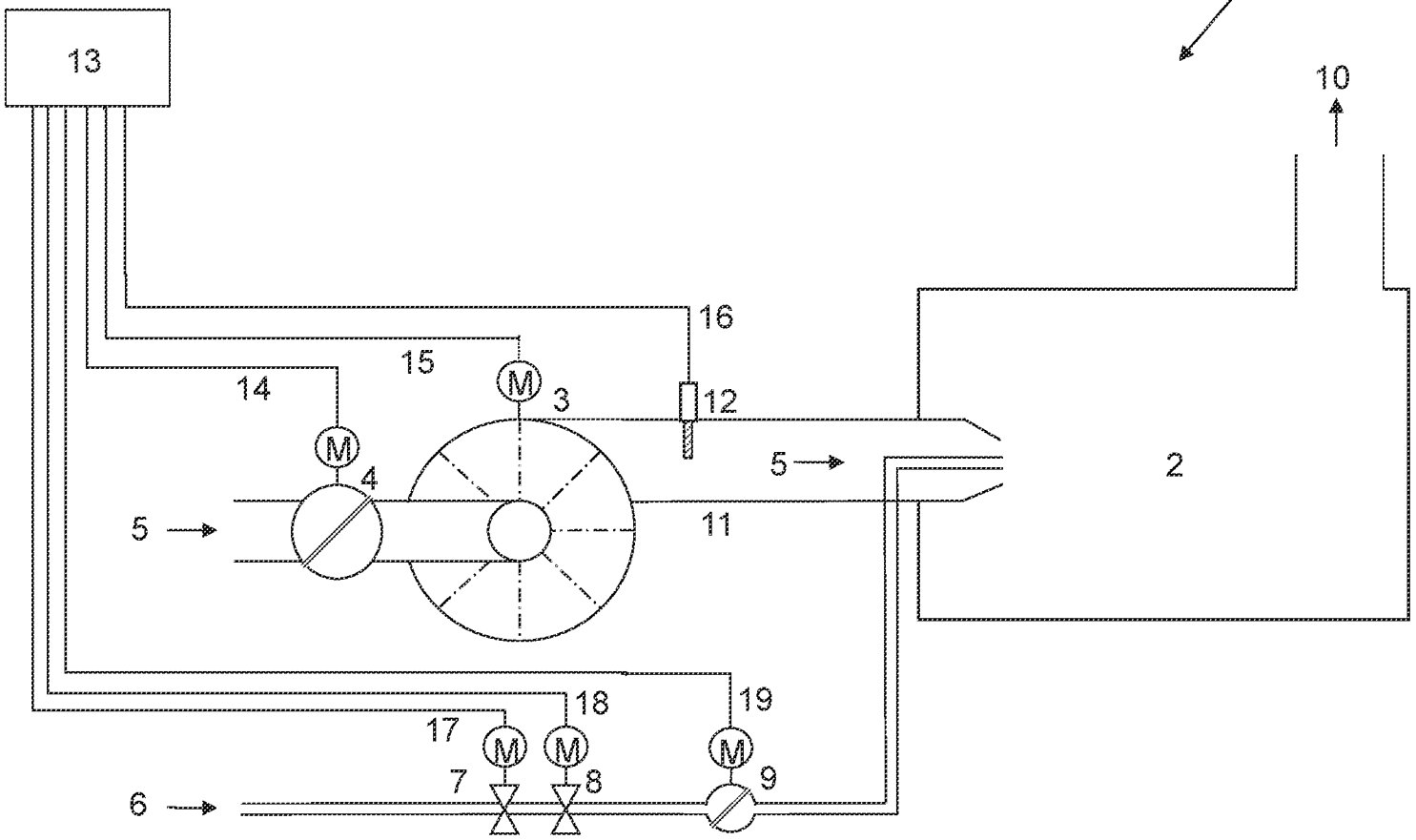
FIG. 1 shows schematically a burner appliance without ascertaining λ.

The teachings of the present disclosure describe methods with which by determining and/or providing a fuel parameter h, it is possible to directly determine the actual value $P_{ist}$ of the power output of the burner appliance by way of the air supply $\dot{V}_L$. The air ratio λ is used in the determination. The specific parameter for the fuel can be calculated for example from values in literature. The actual value $P_{ist}$ of the power output of the burner appliance can be specified in kilowatt. The actual value $P_{ist}$ of the power output of the burner appliance can also be specified relative to a reference value, with the result that the relative actual value $P_{ist}$ of the power output of the burner appliance is specified as a percentage of the reference value. A typical reference value is in this case the maximum power output $P_{max}$ of the burner appliance.

In some embodiments, only one air supply characteristic curve is required. The actual value $P_{ist}$ of the power output of the burner appliance can be allocated to the air supply $\dot{V}_L$. In the case of a change of the fuel and/or of the fuel composition, the fuel supply characteristic curve is corrected. This is performed manually in the case of a system that does not ascertain λ. Otherwise, the correction can be performed with the aid of a λ regulation. The actual value $P_{ist}$ of the power output of the burner appliance is calculated from the known air supply $\dot{V}_L$ at the characteristic curve point with the aid of the known measured value of the air ratio λ and from the individual, scalar fuel parameter $$h = \frac{H_U}{L_{min}}$$

to form $$P = \frac{h}{\lambda} \cdot \dot{V}_L.$$

The minimum air requirement $L_{min}$ is a property of the fuel gas. The minimum air requirement $L_{min}$ describes the air quantity that is required for a quantity of fuel in stoichiometry, in other words λ=1. The fuel parameter h is allocated to a fuel. The fuel parameter h can also be allocated to a fuel group that is composed from fuel whose fuel parameters h lie as close as possible.

Conversely, it is also possible to determine the air supply $\dot{V}_L$ for a specific target value $P_{soll}$ of the power output of the burner appliance. Consequently, the characteristic curve point is likewise predetermined as the target for the air supply $\dot{V}_L$, for example. For the fuel-specific value h, the two parameters $L_{min}$ and $H_U$ must relate to the same quantity value. In other words, either $H_U$ is specified in megajoule/kilomole and $L_{min}$ in kilomole/kilomole or $H_U$ in megajoule/cubic meter and $L_{min}$ in cubic meter/cubic meter. These specifications assume the same environmental conditions such as temperature and pressure. Thus, the actual value $P_{ist}$ of the power output of the burner appliance can be directly adjusted by way of a power output regulator. For this purpose, the target air supply $\dot{V}_{Lsoll}$ is calculated from the target power output value $P_{soll}$ with the aid of λ and h to $$\dot{V}_{Lsoll} = \frac{\lambda}{h} \cdot P_{soll}.$$

The actual air supply $\dot{V}_{List}$ is subsequently adjusted by way of a measurement variable to the target value $\dot{V}_{Lsoll}$. The fuel supply $\dot{V}_B$ follows on account of the respectively adjusted λ value of the air supply $\dot{V}_L$.

In some embodiments, the method renders it possible to determine the actual value $P_{ist}$ of the power output of the burner appliance with the aid of the air supply $\dot{V}_L$.

In some embodiments, the methods may be used to adjust the air ratio λ with the aid of the $O_2$ control loop using the determined correct fuel supply $\dot{V}_B$ as an actual value and the target value that originates from a target value characteristic curve that is determined by way of an $O_2$ regulation. In this case, rapid power output changes occur with the aid of the stored characteristic curves. In particular, the prevailing power output is also determined in the case of changing fuels with the aid of the λ value that is determined by measuring the $O_2$ value and/or with the aid of the target value of λ.

In some embodiments, with the aid of the currently determined power output a predetermined power output value is adjusted by way of a power output control loop.

In some embodiments, with the aid of a predetermined power output upper limit in the case of changing fuels the maximum fuel supply $\dot{V}_B$ is adjusted with the result that the power output upper limit is achieved for each fuel. In some embodiments, the power output upper limit for each fuel is not exceeded.

In some embodiments, with the aid of a predetermined power output lower limit in the case of changing fuels the minimum fuel supply $\dot{V}_B$ is adjusted with the result that the power output lower limit is achieved for each fuel. In some embodiments, the power output is not below the power output lower limit for each fuel.

In some embodiments, with the aid of the adjustment of the fuel actuator it is possible using the λ regulation to estimate and/or determine the individual, scalar fuel parameter h.

In some embodiments, with the aid of the calculated power output value it is possible to determine the energy turnover and/or the power output even in the case of changing fuels.

In some embodiments, with the aid of the calculated power output value and/or with the aid of the calculated energy value it is possible to determine costs for the fuel even in the case of changing fuels.

In some embodiments, a burner appliance has a regulating and/or controlling and/or monitoring facility having instructions in the memory for performing a method that is disclosed herein.

In some embodiments, there is a method and/or an apparatus for determining a burner power output, said method being used in a burner appliance such as for example an industrial combustion plant and/or a heating system and/or an internal combustion engine, for example of an automobile.

FIG. 1 illustrates a burner appliance 1 such as for example a wall-hanging gas burner and/or an oil burner. During the operation, a flame of a heat generator burns in the combustion chamber 2 of the burner appliance 1. The heat generator exchanges the thermal energy of the hot fuels and/or fuel gases into another fluid such as for example water. The warm water is used for example to operate a hot water heating system and/or to heat up drinking water. In some embodiments, it is possible using the thermal energy of the hot fuel gases to heat up a product for example in an industrial process. In some embodiments, the heat generator is part of a system having a power output heat coupling, for example a motor of such a system. In some embodiments, the heat generator is a gas turbine. Moreover, the heat generator can serve to heat up water in a system for the extraction of lithium and/or lithium carbonate. The exhaust gases are discharged from the combustion chamber 2 for example by way of a chimney.

The supply air 4 for the combustion process is supplied by way of a (motorized) operated blower 3 of the burner appliance 1. By way of the signal line 15, the regulating and/or controlling and/or monitoring facility 13 specifies to the blower 3 the air supply $\dot{V}_L$ that it is to convey. Consequently, the blower rotational speed is a measurement for the transported air quantity.

In some embodiments, the blower rotational speed of the regulating and/or controlling and/or monitoring facility 13 is reported back by the blower 3. If the air quantity is adjusted by way of an air flap 4 and/or a valve, it is possible to use the flap position and/or the valve position and/or the measured value that is derived from the signal of a mass flow sensor 12 and/or volume flow sensor as a measurement for the air quantity. The sensor may be arranged in the duct 5 for the air supply $\dot{V}_L$. In some embodiments, the sensor provides a signal which is converted into a flow measurement value with the aid of a suitable signal processing facility. A signal processing facility comprises ideally at least one analogue-digital converter. In some embodiments, the signal processing unit, in particular the analogue-digital converter or the analogue-digital converters, is integrated in the regulating and/or controlling and/or monitoring facility 13.

It is also possible to use the measurement value of a pressure sensor and/or of a mass flow sensor 12 in a side duct as a measurement for the air supply $\dot{V}_L$. A combustion facility having a supply duct and side duct is disclosed for example in the European patent EP3301364B1. The European patent EP3301364B1 was submitted on Jul. 7, 2017 and granted on Aug. 7, 2019. Said patent claims a combustion facility having a supply duct and side duct, wherein a mass flow sensor protrudes into the supply duct.

The sensor 12 determines a signal that corresponds to the pressure value, which is dependent upon the air supply $\dot{V}_L$, and/or to the airflow (particle flow and/or mass flow) in the side duct. In some embodiments, the sensor 12 provides a signal which is converted into a measurement value with the aid of a suitable signal processing facility. In some embodiments, the signals of multiple sensors are converted into a common measurement value.

A suitable signal processing facility comprises ideally at least one analogue-digital converter. In some embodiments, the signal processing facility, in particular the analogue-digital converter or the analogue-digital converters, is integrated in the regulating and/or controlling and/or monitoring facility 13.

In some embodiments, the airflow $\dot{V}_L$ is the value of the prevailing air through flow rate. The air through flow rate can be measured and/or specified in cubic meters of air per hour. The air supply $\dot{V}_L$ can be measured and/or specified in cubic meters of air per hour.

Mass flow sensors 12 render it possible to perform the measurement during the operation in the case of high flow rates especially in conjunction with burner facilities. Typical values of such flow rates lie in the ranges between 0.1 meters per second and 5 meters per second, 10 meters per second, 15 meters per second, 20 meters per second, or even 100 meters per second. Mass flow sensors that are suitable for the present disclosure are for example OMRON® D6F-W or SENSOR TECHNICS® WBA type sensors. The usable range of these sensors commences typically at rates between 0.01 meters per second and 0.1 meters per second and ends at a rate such as for example 5 meters per second, 10 meters per second, 15 meters per second, 20 meters per second, or even 100 meters per second. In other words, lower limits such as 0.1 meters per second can be combined with upper limits such as 5 meters per second, 10 meters per second, 15 meters per second, 20 meters per second or even 100 meters per second.

The fuel supply $\dot{V}_B$ is adjusted and/or regulated by the regulating and/or controlling and/or monitoring facility 13 with the aid of a fuel actuator and/or a (motorised) adjustable valve. The fuel in the embodiment illustrated in FIG. 1 is a fuel gas. A burner appliance 1 can then be connected to different fuel gas sources, for example to sources having a high methane content and/or sources having a high propane content. In FIG. 1, the quantity of fuel gas is adjusted by a (motorized) adjustable fuel valve 9 by the regulating and/or controlling and/or monitoring facility 13. In this case, the control value 19, for example in the case of a pulse width modulated signal of the gas valve, is a measurement for the quantity of fuel gas. It is also a value 19 for the fuel supply $\dot{V}_B$.

In some embodiments, the fuel valve 9 is adjusted with the aid of a step motor. In such a case, the step position of the step motor is a measurement for the quantity of fuel gas. The fuel valve 9 can also be integrated in a unit having at least one or both safety shut-off valves 7 or 8. Furthermore, the fuel valve 9 can be a valve that is regulated internally by way of a through-flow sensor, comprises a target value 19 and adjusts the actual value of the through-flow sensor to the target value 19. In this case, the through-flow sensor can be realized as a volume flow sensor, for example as a turbine wheel meter, bellows meter and/or differential pressure sensor. The through-flow sensor can also be embodied as a mass flow sensor, for example as a thermal mass flow sensor.

If a gas flap is used as an actuator 9, then it is possible to use the position of a flap as a measurement for the quantity of fuel gas. In some embodiments, it is also possible to use as a measurement for the quantity of fuel gas the measurement value that is derived from the signal of a mass flow sensor and/or of a volume flow sensor. This sensor may be arranged in the supply duct for the fuel. This sensor generates a signal that is converted with the aid of a suitable signal processing facility into a flow measurement value (measurement value of the particle flow and/or mass flow and/or volume flow). A suitable signal processing facility comprises ideally at least one analogue-digital converter. In accordance with one embodiment, the signal processing facility, in particular the analogue-digital converter or the analogue-digital converters, is integrated in the regulating, controlling and monitoring facility 13.

The person skilled in the art recognizes that the above-mentioned values can also be calculated from a combination of variables that are determined by sensors. Those values are then measurements for the supply (particle flow and/or mass flow and/or volume flow) of a fuel gas. The person skilled in the art recognizes furthermore that the supply of fuel of a liquid fuel can be determined in a similar manner.

Figure 2:
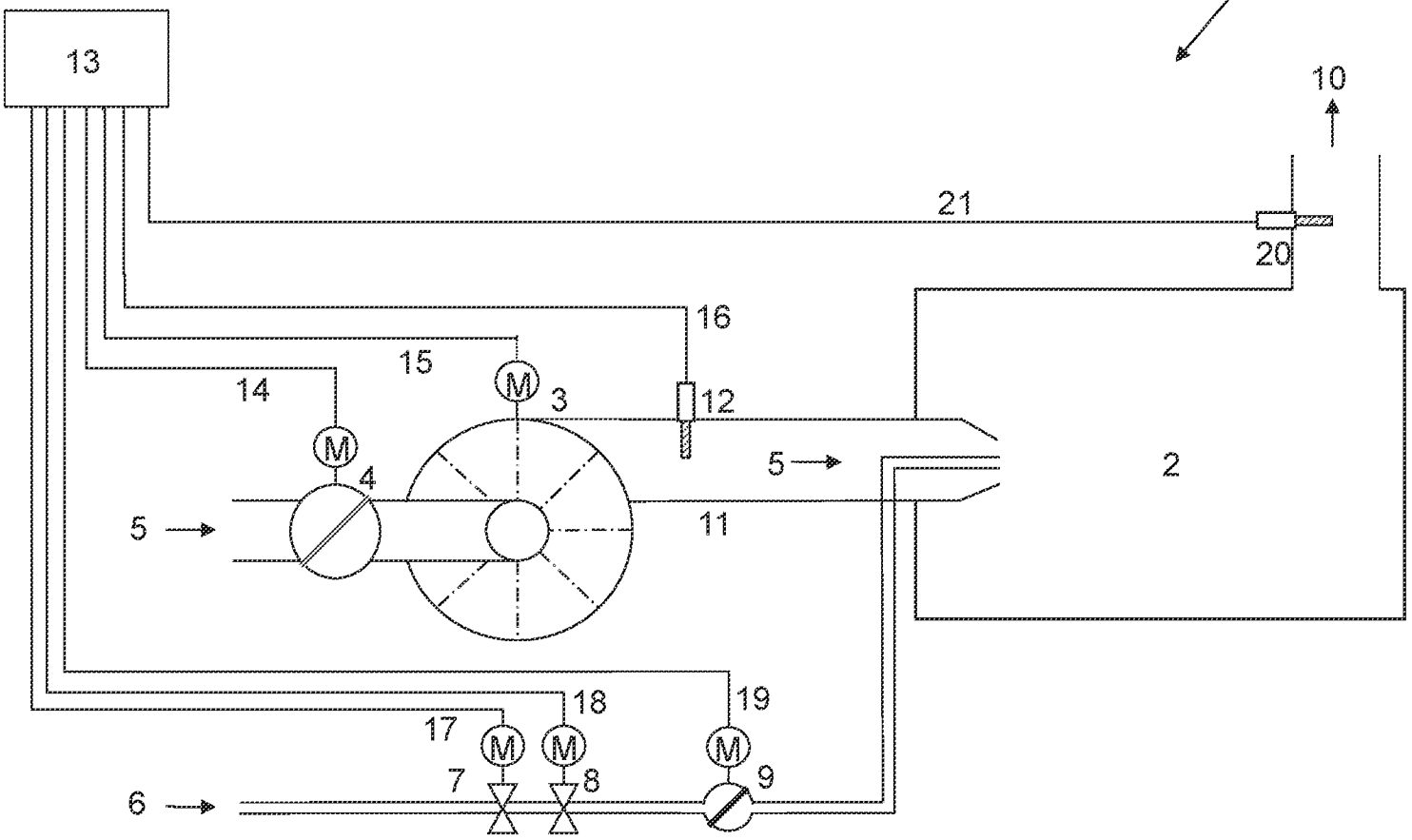
FIG. 2 shows a burner appliance having an $O_2$ sensor for ascertaining λ in the exhaust gas.

FIG. 2 illustrates a burner appliance 1 having an air ratio sensor 20 for ascertaining the air ratio λ. The air ratio sensor 20 for ascertaining the air ratio λ comprises for example an $O_2$ sensor. In one embodiment, the air ratio sensor 20 for ascertaining the air ratio λ is an $O_2$ sensor. The air ratio sensor 20 for ascertaining the air ratio λ can be arranged for example in the combustion chamber 2 and/or in the exhaust gas path.

The air ratio sensor 20 for ascertaining the air ratio λ generates a signal 21. The signal 21 is read in by the regulating and/or controlling and/or monitoring facility 13 and suitably evaluated. With the aid of the signal 21, it is possible to adjust for each air supply $\dot{V}_L$ a predetermined air ratio λ. In this case, the measured air supply $\dot{V}_L$ is adjusted by way of the actuator 9 in the fuel supply $\dot{V}_B$ and/or by way of the actuator 3, 4 in the air supply $\dot{V}_L$ to a predetermined target value.

Figure 3:
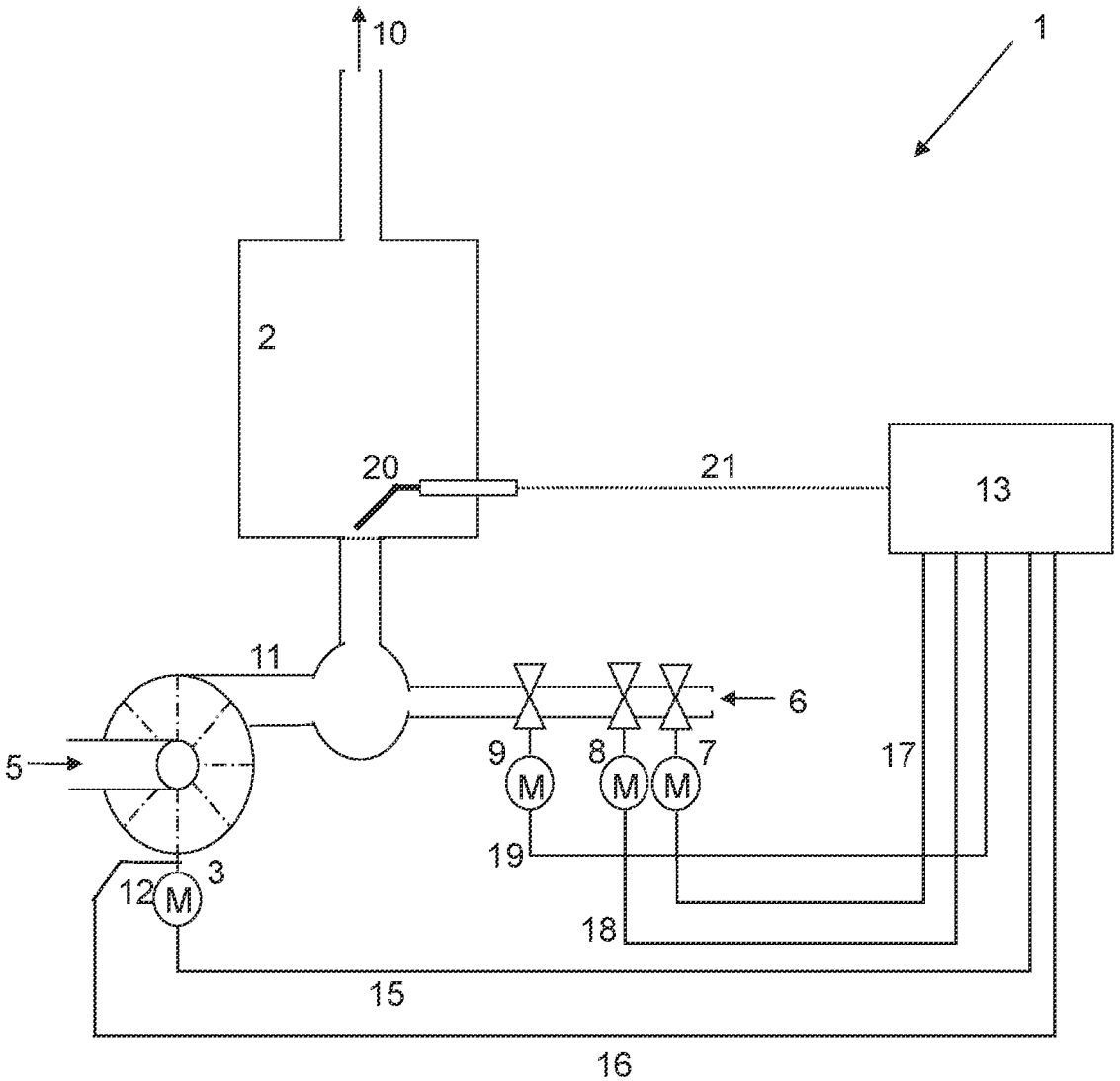
FIG. 3 shows a burner appliance having an ionization electrode for ascertaining λ.

FIG. 3 illustrates a burner appliance 1 having an air ratio sensor 20 for ascertaining the air ratio λ comprising an ionization electrode. KANTHAL®, e.g. APM® or A-1® are often used as material for an ionization electrode. Electrodes embodied from Nikrothal® are also considered by the person skilled in the art. The ionization electrode can be arranged for example in the combustion chamber 2.

Figure 4:
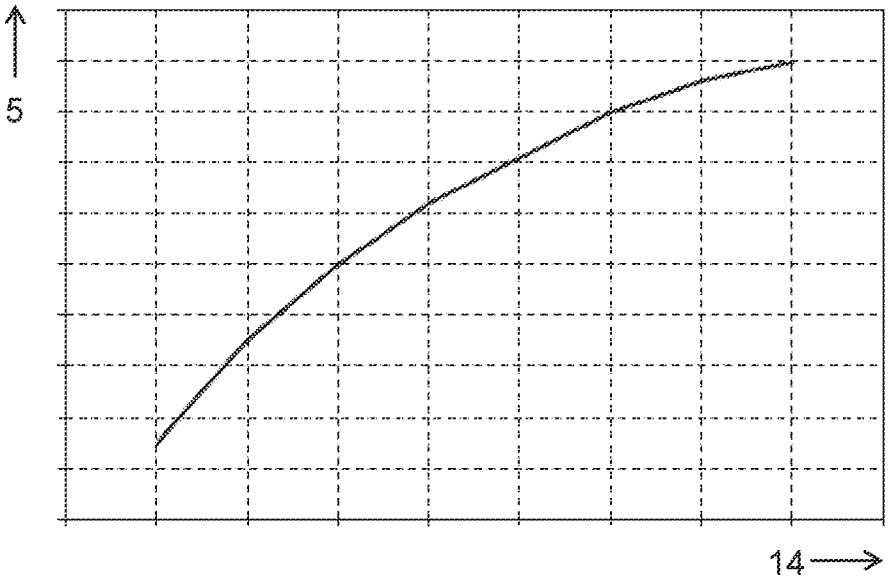
FIG. 4 shows a characteristic curve of the air supply by way of the air flap position.

The measurement variable for the fuel supply $\dot{V}_L$ can be available as a direct characteristic curve of the air supply $\dot{V}_L$ by way of a blower rotational speed or of the air supply $\dot{V}_L$ by way of the air flap position. The air flap position can be specified for example as an actuating angle. A combination of a rotational speed and an actuating angle is also possible. FIG. 4 illustrates such a direct characteristic curve.

Figure 5:
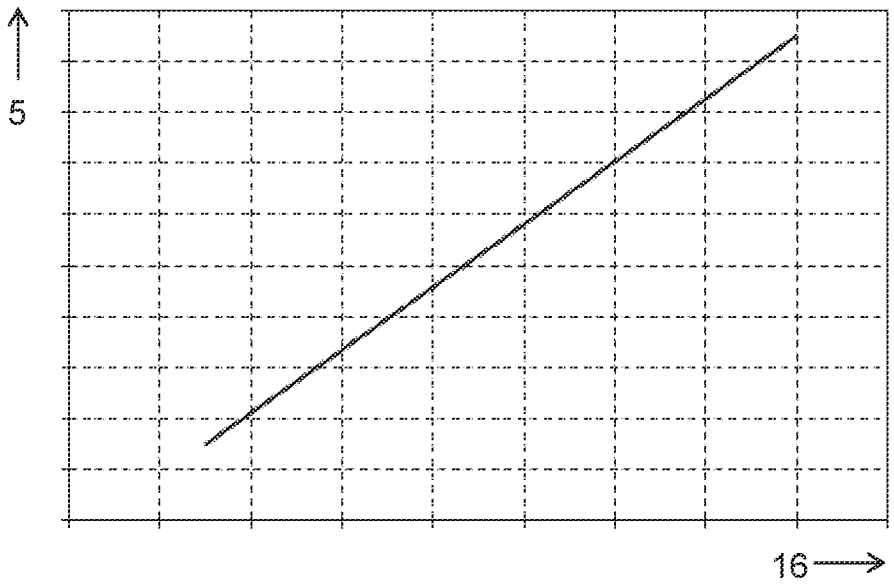
FIG. 5 shows a characteristic curve of the air supply by way of a measured air mass flow, wherein the measurement of the air mass flow can be arranged in the bypass.

Ideally the air supply $\dot{V}_L$ can be determined using an air mass flow sensor. A corresponding characteristic curve is illustrated in FIG. 5. The air mass flow sensor can be arranged for example directly in the air supply duct 11.

The air mass flow sensor can also be arranged in a bypass on the air supply duct 11 above an aperture. An arrangement having a bypass is known for example from the European patent EP3301362B1. The air mass flow sensor can furthermore be arranged in a bypass over an air flap that acts as an aperture.

The air supply $\dot{V}_L$ is then determined for example from a combination of the air mass flow signal and the air flap position or however from the air mass flow signal and the blower rotational speed or from all three. In principle, it is also possible to determine the air supply $\dot{V}_L$ with the aid of a differential pressure sensor above an aperture or an air flap, also in any combination with an air mass flow sensor, a blower rotational speed and/or an air flap position.

Said air supply sensors form in this case a different measurement for the air supply $\dot{V}_L$. The measurement result obtained from the rotational speed and the flap position is thus dependent upon further environmental conditions, such as air pressure, air temperature and exhaust gas path. In order to increase the measurement accuracy of $\dot{V}_L$, it is possible to also include in the determination measurement values of the environmental conditions, such as supply air temperature, air humidity or absolute air pressure. If an air mass flow sensor or a differential pressure sensor is used, then it is possible to determine the air supply $\dot{V}_L$ even without influences of the environmental condition. Depending upon the measurement variables, the influences of the environment that are not taken into consideration, such as also the accuracy of the measurement result, are reflected in the accuracy of the actual value $P_{ist}$ of the power output of the burner appliance 1. The air supply $\dot{V}_L$ and/or the actual value $P_{ist}$ of the power output of the burner appliance 1 can be calculated in this case in an absolute or relative manner with respect to the maximum value of the characteristic curve and/or another value.

Figure 6:
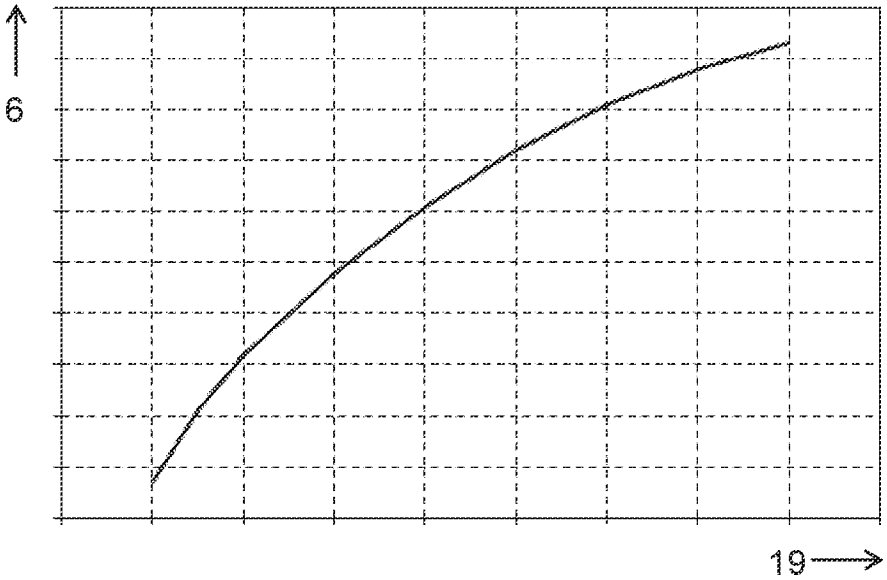
FIG. 6 shows a characteristic curve of the fuel supply by way of the fuel flap position.

Corresponding considerations such as for the measurement of the air supply $\dot{V}_L$ apply for the measurement of the fuel supply $\dot{V}_B$. The measurement variable for the fuel supply $\dot{V}_B$ can be a direct characteristic curve of the fuel supply $\dot{V}_B$ by way of the fuel valve position. The fuel valve position can be specified for example as an actuating angle. FIG. 6 illustrates such a direct characteristic curve.

In some embodiments, the air supply characteristic curve can be preset on a burner appliance 1 in the factory using for example an air mass flow sensor or a rotational speed sensor. In some embodiments, it is also possible to calculate said characteristic curve for an individual burner appliance 1 by way of a fuel meter and/or fuel gas meter for determining $\dot{V}_B$ using a known fuel and an air ratio sensor 20 for ascertaining the air ratio $\lambda$. The relationship by way of $\dot{V}_L=\lambda\cdot L_{min}\cdot\dot{V}_B$ between the air supply $\dot{V}_L$, air ratio $\lambda$, known minimum air requirement $L_{min}$ and known fuel supply $\dot{V}_B$ is used for the calculation.

If the air supply $\dot{V}_L$, as illustrated above, is adjusted in the factory or on the burner appliance 1 on site, then it is possible after adjusting the air ratio $\lambda$ to determine the power output $P_{ist}$ for each fuel. The known parameters are used for this purpose. Using only one air supply characteristic curve, it is possible to limit the burner for each fuel with a known parameter $$h = \frac{H_U}{L_{min}}$$

within a range between a maximum power output $P_{soll\text{-}max}$ and a minimum power output $P_{soll\text{-}min}$. In this case, the target specification of the air supply $\dot{V}_L$ is limited according to $$\dot{V}_{Lsoll-max} = \frac{\lambda}{h}\cdot P_{soll-max}$$

and/or to $$\dot{V}_{Lsoll-min} = \frac{\lambda}{h}\cdot P_{soll-min}.$$

In the case of changes in the fuel or the air ratio $\lambda$, the actual value $P_{ist}$ of the power output of the burner appliance 1 can be re-calculated directly at any point and/or adjusted and/or limited.

In order to manually adjust the power output of a fuel, it is necessary to know the minimum air requirement $L_{min}$, fuel parameter $$h = \frac{H_U}{L_{min}}$$

and the target value for the air ratio $\lambda$.

Initially, the fuel supply is calculated by way of $$\dot{V}_B = \frac{\dot{V}_L}{\lambda\cdot L_{min}}$$

and adjusted. It is often not possible to input the fuel supply $\dot{V}_B$ directly. The fuel supply $\dot{V}_B$ is then only known by way of a reference characteristic curve $\dot{V}_{B0}$ in dependence upon the actuating angle of a fuel flap or of a fuel valve in accordance with FIG. 6 for a reference gas having a minimum air requirement $L_{min0}$. Then, the new fuel supply is then calculated to $$\dot{V}_B = \frac{L_{min0}}{L_{min}}.$$

$\dot{V}_{B0}$ for another fuel having the minimum air requirement $L_{min}$ for an identical air ratio $\lambda$ and the identical air supply $\dot{V}_L$ such as in the case of the reference adjustment. In the event that in addition the air ratio $\lambda$ changes with respect to the adjusting $\lambda_0$ with the reference gas, then $$\dot{V}_B = \frac{\lambda_0 \cdot L_{min0}}{\lambda \cdot L_{min}} \cdot \dot{V}_{B0}$$

is calculated. In the case of the change to the new fuel, the fuel actuator 9 is adjusted to the extent that the fuel supply 6 that is allocated to each air supply point is changed by the factor $$\frac{\lambda_0 \cdot L_{min0}}{\lambda \cdot L_{min}}$$

and/or in the case of the same value of λ is changed by the factor $$\frac{L_{min0}}{L_{min}}.$$

After multiplying the fuel supply 6 by the determined factor, it is possible with the aid of the known characteristic curve illustrated in FIG. 6 to determine directly the new control values and/or actuating angle 19 for the changed fuel composition. In this case, the characteristic curve can be provided for example in the form of a table, the intermediate values of which are interpolated in a linear manner. Furthermore, the characteristic curve can be provided as a mathematical formula and/or as a mathematical relationship.

The power output can be calculated in the case of the identical air supply $\dot{V}_L$ in accordance with the calculations above for an unchanged air ratio λ to be $$P_1 = \frac{h_1}{h_0} \cdot P_0$$

and/or in the case of a changed air ratio λ to be $$P_1 = \frac{\lambda_0 \cdot h_1}{\lambda_1 \cdot h_0} \cdot P_0.$$

In the case of the unchanged air ratio λ, the power output is $P_1 \approx P_0$, if $h_1 \approx h_0$. It is possible with the aid of this simple measure using for example parameters $L_{min}$ and $H_U$ that are known from the literature and consequently known fuel parameters $$h = \frac{H_U}{L_{min}}$$

to directly and in a simple manner adjust an appliance to suit a new fuel. It is not necessary to determine new characteristic curves in an empirical manner. In this case, the respective power output $P_{ist}$ is also adjusted to suit the new fuel. It is possible to determine for a target value $P_{soll}$ of the power output of the burner appliance 1 the correct air supply $\dot{V}_L$ and/or the correct fuel supply $\dot{V}_B$.

If the air ratio λ is determined with the aid of an $O_2$ sensor or with the aid of an ionization electrode, it is possible in the case of a change of the fuel composition to maintain the air ratio λ constant by way of a control loop. In the case of an $O_2$ sensor, the air ratio λ is calculated directly from the result value of the sensor in accordance with the prior art. For example, the air ratio λ can be calculated from the oxygen content $O_2$ with the aid of the relationship $$\lambda \approx \frac{20.9}{20.9 - O_2}.$$

The fuel supply $\dot{V}_B$ is then adjusted with the aid of a control loop in such a manner that the target value of λ is achieved. The target value of λ can be dependent upon the air supply $\dot{V}_L$. In the case of using an ionization signal and/or an ionization flow signal for ascertaining λ, the measured ionization flow is adjusted to a target value that is dependent upon the air supply $\dot{V}_L$, in that the fuel supply $\dot{V}_B$ is changed.

In contrast to a reference fuel supply $\dot{V}_{B0}$ that has been set on a burner appliance 1, the new fuel supply is calculated to be $\dot{V}_B = k \cdot \dot{V}_{B0}$, over the entire modulation characteristic curve of the fuel by way of the power output. In this case, an identical air ratio λ is assumed. The actuator is adjusted in this case accordingly so that over the entire modulation range $\dot{V}_{B1}$ is displaced with regard to $\dot{V}_{B0}$ by the factor k. Thus, the changed fuel only needs to be adjusted at a power output point; consequently the factor k is known. The changed fuel actuator positions over the entire power output range are known with the aid of this factor k and consequently the changed modulation characteristic curve is defined. The adjusted factor k is to be recognized in accordance with the calculations above for unchanged λ as $$k = \frac{L_{min0}}{L_{min}}.$$

If other air ratio target values are predetermined for another fuel, for example within the scope of a fuel switchover, then the factor k is adjusted to be $$k = \frac{\lambda_0 \cdot L_{min0}}{\lambda \cdot L_{min}}.$$

If the fuel modulation characteristic curve has been adjusted for a reference gas having a known minimum air requirement $L_{min0}$, then it is possible after adjusting λ by the determined factor k to determine the minimum air requirement necessary for the currently prevailing fuel to be $$L_{min} = \frac{L_{min0}}{k}$$

for an identical λ.

The minimum air requirement is determined to be $$L_{min} = \frac{\lambda_0 \cdot L_{min0}}{\lambda \cdot k}$$

for the changed $\lambda \neq \lambda_0$.

If the fuel composition is known, then the new actual value $P_{ist}$ of the power output of the burner appliance 1 can also be calculated in the case of a changing fuel composition to be $$P_{ist} = \frac{h}{\lambda} \cdot \dot{V}_L$$

as described above for each air supply point. The target value for the air supply $$\dot{V}_{Lsoll} = \frac{\lambda}{h} \cdot P_{soll}$$

can be determined for each target value $P_{soll}$ of the power output of the burner appliance 1.

Figure 7:
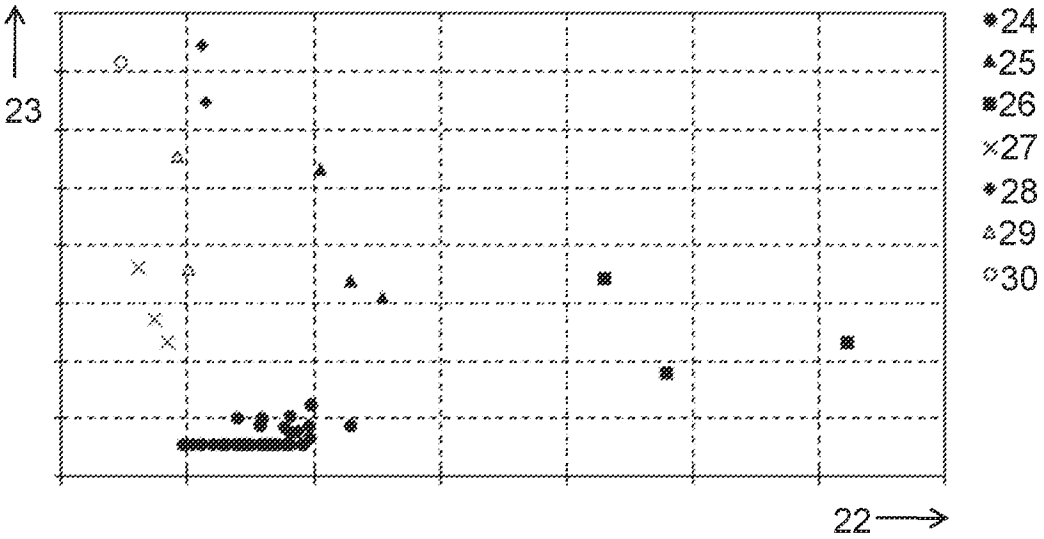
FIG. 7 shows values $h=H_U/L_{min}$ for different gases combined in groups.

FIG. 7 illustrates the correlation between the minimum air requirement 22, $L_{min}$, and the individual scalar fuel parameter 23, $$h = \frac{H_U}{L_{min}},$$

for different fuel gases. As is apparent in FIG. 7, the fuel gases can be combined in groups. The groups are determined by virtue of the fact that for the prevailing air supply $\dot{V}_L$ the actual value $P_{ist}$ of the power output of the burner appliance 1 also remains within predetermined limits in the case of a change of the gas and an adjustment performed on the gas supply in the case of an unchanged air ratio λ. The individual scalar fuel parameter h then lies within the predetermined limits for each of these groups. The limits are determined from the admissible error for the actual value $P_{ist}$ of the power output of the burner appliance 1.

It follows from this that in FIG. 7 the gases that are identified by the numeral 24 are all gases of the second gas family (in accordance with EN437:2009-09) including special gases without Sardinian gas (=propane–air mixture). These gases have methane as a base and are mixed with inert gases or smaller quantities of other fuel gases. If gases are changed within this group and the air ratio λ remains constant by adjusting the fuel supply $\dot{V}_B$, the individual scalar fuel parameter for these gases that are identified by the numeral 24 is $$h = 3.55\frac{MJ}{m^3}, -0\%, +2\%.$$

Consequently, the actual value $P_{ist}$ of the power output of the burner appliance 1 fluctuates in a range of less than 2 percent for these gases after adjusting the air ratio λ in the burner system.

The gases that are identified by the numeral 26 in FIG. 7 are gases of the third gas family (in accordance with EN437:2009-09); these have a fuel parameter of $$h = 3.73\frac{MJ}{m^3}, -0\%, +4.5\%.$$

The error with respect to the gases that are identified by the numeral 24 is less than 8 percent. If this error is acceptable, there is no need to perform a power output correction between the gas group 24 and the gas group 26. Since however it is normally known whether liquid gas (=gases of the third family) is present, the correction can be performed manually, in that the individual scalar fuel parameter $$h = 3.73\frac{MJ}{m^3}$$

is input.

The gases that are identified in FIG. 7 by the numerals 25, 27, 28 and 29 form further special gas groups (Sardinian gas, process gases). It is known in each case if these gases are present and the respective values of the fuel parameter h can be input directly, so that the power output correction can be performed. The errors then lie for example at less than 5.1 percent.

The gas that is identified in FIG. 7 by the numeral 30 is pure hydrogen with $$h = 4.22\frac{MJ}{m^3}.$$

As already mentioned above, in the case of a change within a gas group within the scope of the specified accuracy, it is not necessary to perform a power output correction. In the case of a change from gas group to gas group, it is known which gas group is present. The correction can be performed manually by way of changing h.

Occasionally, the different gases or gases from gas groups come from different fuel supply lines and the shut-off valves of the respective fuel supply lines are switched off and on. It is then possible with the switch-over of the fuel supply $\dot{V}_B$ to also change the gas parameter. Thus, the power output or the burner modulation can be adjusted.

Known fuels are for example:

Natural gas from the supply network,

Liquid gas,

Gas on Sardinia,

Process gases with a known composition (first gas family),

Liquid fuels, such as heating oil EL etc.,

Mixtures comprising hydrogen and

Pure hydrogen.

Because each of the compositions are known, the individual scalar fuel parameter h is also known in each case.

Figure 8:
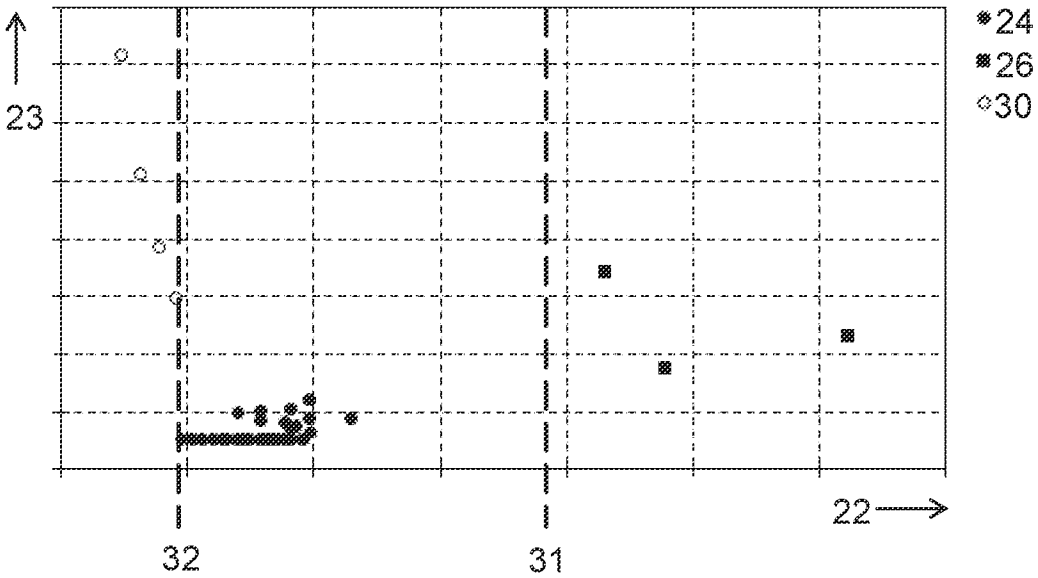
FIG. 8 shows values $h=H_U/L_{min}$ for gas groups without special gases in dependence upon $L_{min}$ with detection limits.

If the special gas groups 15, 27, 28, 29 are excluded, in the case of which it is known when they are present, the power output correction can also be further automated. For this purpose, the new minimum air requirement $$L_{min} = \frac{L_{min0}}{k}$$

is calculated with respect to a reference gas using the factor k that is determined by the regulation. In order to determine the factor k, it is necessary to know the gas supply $\dot{V}_{G0}$ for a reference gas (with $L_{min0}$) in dependence upon the position of the at least one fuel actuator 9 or a linear equivalent to be $\dot{V}_{G0}$. Such a case is illustrated in FIG. 6. The factor k can in this case be determined by a regulation using an $O_2$ sensor, an ionization sensor or any other like-functioning sensor. FIG. 8 serves to illustrate this approach.

If the value 22 of $L_{min}$ is greater than the threshold 31, then it concerns a liquid gas having the value $$h = 3.73\frac{MJ}{m^3}.$$

Between the threshold 31 and the threshold 32, the gas can be interpreted as methane gas with additives. Such is the case essentially for the gases of the second gas family from the supply network. The value $$h = 3.55\frac{MJ}{m^3}$$

is used here. Below the threshold 32, the gas is interpreted as a hydrogen-methane gas mixture. The mixture ratio in FIG. 8 changes there in accordance with a characteristic curve along the points that are identified by the numeral 30 with the composition and consequently with $L_{min}$. It is thus possible using the mixture ratio of the gases and/or fuels to specify the function of the fuel parameters h by way of $L_{min}$. Since in the case of hydrogen having a gas parameter of $$h = 4.22\frac{MJ}{m^3}$$

the deviation with respect to methane with $$h = 3.55\frac{MJ}{m^3}$$

is relatively large, there is particular interest in detecting the H2 content in the methane by way of a λ-regulated burner. Using the specified method, it is possible in the case of the predetermined air ratio λ for hydrogen and for example methane to determine automatically both the air ratio and also the power output of a burner unit and for the control units to be made available.

For the known process gases and also other, for example liquid, fuels, it is assumed that these cannot occur in the general supply network. For these, the individual scalar fuel parameter h is input directly and/or manually into the regulating and/or controlling and/or monitoring facility 13 if the respective fuels are fed in.

It is possible using the currently determined actual value $P_{ist}$ of the power output of the burner appliance 1 to operate the power output regulator directly in a closed control loop. The actual value $P_{ist}$ of the power output of the burner appliance 1 can be adjusted to a predetermined target value $P_{soll}$ of the power output of the burner appliance 1.

The power output target value can be generated by a superordinate temperature control unit. It can also be predetermined directly as a target value by an operating unit and/or a unit for heating a product and/or in the case of combusting a prevailing residual fuel from a chemical process to the power output regulator.

Owing to the $$P_{ist} = \frac{h}{\lambda}\cdot\dot{V}_L = \frac{H_u}{L_{min}}\cdot\frac{\dot{V}_L}{\lambda} = H_u\cdot\dot{V}_B,$$

the maximum fuel supply $\dot{V}_{Bmax}$ is implicitly adjusted for the maximum power output $P_{max}$ of the fuel facility 1 and for the minimum power output $P_{min}$ of the fuel facility 1 the minimum fuel supply $\dot{V}_{Bmin}$ is implicitly adjusted. Equivalently, $\dot{V}_{Bmax}$ and/or $\dot{V}_{Bmin}$ can be calculated and limited upward for the respective fuel and/or downward to these calculated values (directly). In any case, it is consequently ensured that the burner appliance is not operated outside the intended power output range.

It is possible in a simple manner to calculate the energy turnover from the determined actual value $P_{ist}$ of the power output of the burner appliance 1, in that the actual value $P_{ist}$ of the power output of the burner appliance 1 is integrated over time. It is thus possible to calculate the energy turnover even in the case of changing fuels.

If it is known when the fuel is switched over, it is possible to calculate the energy turnover for the individual fuels. In the case of an automatic recognition of the fuel parameter h, it is possible to detect the switch over by way of the change from h.

If the energy turnover is known, then it is possible to determine the energy costs directly insofar as the costs per energy unit are known. If the costs for individual fuels are different, then this can be detected as described above. Thus, the costs for the consumption of individual fuels can be calculated.

Parts of a control unit and/or of a method incorporating teachings of the present disclosure can be realized as hardware and/or as a software module, which is provided by a computing unit likewise with reference to container virtualization, and/or with the aid of a cloud computer and/or with the aid of a combination of previously mentioned possibilities. The software may be a firmware and/or a hardware driver, which is provided within an operating system, and/or may comprise a container virtualization and/or an application program. The present disclosure therefore also relates to a computer program product that comprises the features of this disclosure and/or performs the necessary steps.

In the case of software, the described functions can be stored as one or more commands on a computer-readable medium. Some examples of computer-readable media include a main memory (RAM) and/or a magnetic main memory (MRAM) and/or an exclusively readable memory (ROM) and/or flash memory and/or an electronically programmable ROM (EPROM) and/or an electronically programmable and deletable ROM (EEPROM) and/or a register of a computing unit and/or a hard drive and/or an interchangeable storage unit and/or an optical memory and/or any suitable medium which can be accessed by a computer or by other IT apparatuses and applications.

In some embodiments, a burner appliance 1 comprises a combustion chamber 2, an air supply duct 11 that leads to the combustion chamber 2 and comprises at least one air actuator 3, 4 that is configured to adjust a value of an air supply $\dot{V}_L$ through the air supply duct 11, and a fuel supply duct 6 that leads to the combustion chamber 2 and comprises at least one fuel actuator 9 that is configured to adjust a value of a fuel supply $\dot{V}_B$ through the fuel supply duct 6. An example method comprises: measuring and/or predetermining a value of an air supply $\dot{V}_L$ through the air supply duct 11; measuring and/or predetermining a value of an air ratio λ; providing an individual scalar fuel parameter h; calculating an actual value $P_{ist}$ of a power output of the burner appliance 1 from the measured and/or predetermined value of the air supply $\dot{V}_L$, the measured and/or predetermined value of the air ratio λ and the individual scalar fuel parameter h; and regulating the burner appliance 1 with the aid of at least one actuator that is selected from the at least one fuel actuator 9 and the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In other words, the present disclosure teaches a method for regulating a burner appliance 1, the burner appliance 1 comprising a combustion chamber 2, an air supply duct 11 that leads to the combustion chamber 2 and comprises at least one air actuator 3, 4 that is configured to adjust a value of an air supply $\dot{V}_L$ through the air supply duct 11, and a fuel supply duct 6 that leads to the combustion chamber 2 and comprises at least one fuel actuator 9 that is configured to adjust a value of a fuel supply $\dot{V}_B$ through the fuel supply duct 6, the method comprising the steps: measuring and/or predetermining a value of an air supply $\dot{V}_L$ through the air supply duct 11; measuring and/or predetermining a value of an air ratio λ; providing an individual scalar fuel parameter h; calculating an actual value $P_{ist}$ of a power output of the burner appliance 1 from the measured and/or predetermined value of the air supply $\dot{V}_L$, the measured and/or predetermined value of the air ratio λ and the individual scalar fuel parameter h in accordance with $$P_{ist} = \frac{h}{\lambda} \cdot \dot{V}_L;$$

and regulating the burner appliance 1 with the aid of the at least one fuel actuator 9 and of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, the method further comprises: receiving a power output request signal; and processing the power output request signal to a target value $P_{soll}$ of the power output of the burner appliance 1.

In some embodiments, the method further comprises: receiving a power output request signal by the burner appliance 1; and processing the power output request signal to a target value $P_{soll}$ of the power output of the burner appliance 1.

In some embodiments, the method further comprises determining and/or predetermining an individual scalar fuel parameter h. The individual scalar fuel parameter h is not a vector. The individual scalar fuel parameter h is different to a vector. The individual scalar fuel parameter h does not comprise a series, in particular a time series, of values or parameters. The individual scalar fuel parameter h is different to a series. The individual scalar fuel parameter h is different to a time series. The individual scalar fuel parameter h is not a characteristic curve and does not comprise a characteristic curve. The individual scalar fuel parameter h is different to a characteristic curve.

In some embodiments, the method further comprises calculating an actual value $P_{ist}$ of a power output of the burner appliance 1 from the measured and/or predetermined value of the air supply $\dot{V}_L$, the measured and/or predetermined value of the air ratio λ and exclusively from the individual scalar fuel parameter h. The previously mentioned calculation of the actual value $P_{ist}$ of a power output of the burner appliance 1 does not include in particular any characteristic curves nor a characteristic curve for the fuel parameter h.

In some embodiments, the predetermined value of an air supply $\dot{V}_L$ is a provided value for an air supply $\dot{V}_L$. In some embodiments, the predetermined value of an air ratio λ is a provided value of an air ratio λ.

In some embodiments, the method further comprises: comparing the actual value $P_{ist}$ of the power output of the burner appliance 1 with the target value $P_{soll}$ of the power output of the burner appliance 1; determining a correction signal from the comparison of the actual value $P_{ist}$ of the power output of the burner appliance 1 with the target value $P_{soll}$ of the power output of the burner appliance 1 and outputting the correction signal to at least one actuator selected from the at least one fuel actuator 9 and the at least one air actuator 3, 4.

In some embodiments, the method further comprises: comparing the actual value $P_{ist}$ of the power output of the burner appliance 1 with the target value $P_{soll}$ of the power output of the burner appliance 1; determining a correction signal from the comparison of the actual value $P_{ist}$ of the power output of the burner appliance 1 with the target value $P_{soll}$ of the power output of the burner appliance 1; and outputting the correction signal to at least one actuator selected from the at least one fuel actuator 9 and the at least one air actuator 3, 4;

until the target value $P_{soll}$ of the power output of the burner appliance 1 is achieved.

In some embodiments, the burner appliance 1 comprises at least one air ratio sensor 20 in the combustion chamber 2, and the method further comprises: ascertaining at least one air ratio signal 21 by the at least one air ratio sensor 20 in the combustion chamber 2; and processing the at least one air ratio signal 21 to the measured value of the air ratio λ.

In some embodiments, the burner appliance 1 comprises an exhaust gas duct that leads off from the combustion chamber 2 and at least one air ratio sensor 20 in the exhaust gas duct, wherein the exhaust gas duct is different to the air supply duct 11 and different to the fuel supply duct 6, and the method comprises: ascertaining at least one air ratio signal 21 by the at least one air ratio sensor 20 in the exhaust gas duct; and processing the at least one air ratio signal 21 to the measured value of the air ratio λ.

In some embodiments, the burner appliance 1 comprises at least one air supply sensor 12 in the or on the air supply duct 11, wherein the at least one air supply sensor 12 is in fluid connection with the air supply duct 11, and the method further comprises: ascertaining at least one air supply signal 16 by the at least one air supply sensor 12; and processing the at least one air supply signal 16 to the measured value of the air supply $\dot{V}_L$.

In some embodiments, the method further comprises: transmitting an air actuator signal to the at least one air actuator 3, 4; adjusting a value of an air supply $\dot{V}_L$ through the air supply duct 11 with the aid of the at least one air actuator 3, 4 as a function of the air actuator signal; and determining the predetermined value of the air supply $\dot{V}_L$ through the air supply duct 11 as a function of the air actuator signal or as a function of a rotational speed that is reported back.

In some embodiments, the method further comprises: transmitting an air actuator signal to the at least one air actuator 3, 4; adjusting a value of an air supply $\dot{V}_L$ through the air supply duct 11 with the aid of the at least one air actuator 3, 4 as a function of the air actuator signal; and determining the predetermined value of the air supply $\dot{V}_L$ through the air supply duct 11 as a function of the air actuator signal and/or as a function of a rotational speed that is reported back.

In some embodiments, the method further comprises: calculating a ratio h/λ from the individual scalar fuel parameter h and the value of the air ratio λ; and calculating an actual value $P_{ist}$ of the power output of the burner appliance 1 as a function of the calculated ratio h/λ and as a function of the value of the air supply $\dot{V}_L$.

In some embodiments, the method further comprises: calculating a ratio h/λ from the value of the air ratio λ and exclusively from the individual scalar fuel parameter h; and calculating an actual value $P_{ist}$ of the power output of the burner appliance 1 as a function of the calculated ratio h/λ and as a function of the value of the air supply $\dot{V}_L$. The previously mentioned calculation of a ratio h/λ does not include in particular a characteristic curve nor a characteristic curve for the fuel parameter h.

In some embodiments, the method further comprises: calculating a ratio h/λ as a quotient from the individual scalar fuel parameter h and the value of the air ratio λ; and calculating an actual value $P_{ist}$ of the power output of the burner appliance 1 as a function of the calculated ratio h/λ and as a function of the value of the air supply $\dot{V}_L$.

In some embodiments, the method further comprises calculating an actual value $P_{ist}$ of the power output of the burner appliance 1 by multiplying the calculated ratio h/λ by the value of the air supply $\dot{V}_L$.

In some embodiments, the method further comprises calculating an actual value $P_{ist}$ of the power output of the burner appliance 1 by multiplying the calculated ratio h/λ by the value of the air supply $\dot{V}_L$.

In some embodiments, the method further comprises: providing the individual scalar fuel parameter h as energy of a fuel per air volume and/or per air mass and/or per amount of substance of the air supply $\dot{V}_L$ in the case of stoichiometric portions of the fuel supply $\dot{V}_B$ and air supply $\dot{V}_L$; and calculating the ratio h/λ from the provided individual scalar fuel parameter h and the value of the air ratio λ.

In some embodiments, the method further comprises: providing the individual scalar fuel parameter h as energy of a fuel per air volume and/or per air mass and/or per amount of substance of the air supply $\dot{V}_L$ in the case of stoichiometric portions of the fuel supply $\dot{V}_B$ and air supply $\dot{V}_L$; and calculating the ratio h/λ from the value of the air ratio λ and exclusively from the provided individual scalar fuel parameter h. The previously mentioned calculation of the ratio h/λ does not include in particular a characteristic curve nor a characteristic curve for the fuel parameter h.

In some embodiments, the method further comprises: providing the individual scalar fuel parameter h as a fuel power output per air supply $\dot{V}_L$ in the case of stoichiometric portions of the fuel supply $\dot{V}_B$ and the air supply $\dot{V}_L$; and calculating a ratio h/λ from the provided individual scalar fuel parameter h and the value of the air ratio λ. In some embodiments, the fuel power output is a fuel energy per time.

In some embodiments, the method further comprises: providing the individual scalar fuel parameter h as fuel energy per air volume in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as fuel energy per air mass in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as fuel energy per quantity of substance of air in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as energy of a fuel per volume of the air supply $\dot{V}_L$ in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as energy of a fuel per mass of the air supply $\dot{V}_L$ in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as energy of a fuel per quantity of substance of the air supply $\dot{V}_L$ in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as energy of a fuel group per volume of the air supply $\dot{V}_L$ in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as energy of a fuel group per mass of the air supply $\dot{V}_L$ in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the method further comprises: providing the individual scalar fuel parameter h as energy of a fuel group per quantity of substance of the air supply $\dot{V}_L$ in the case of stoichiometric portions of the fuel supply $\dot{V}_B$ and the air supply $\dot{V}_L$; and calculating a ratio h/λ from the provided individual scalar fuel parameter h and the value of the air ratio λ.

In some embodiments, the individual scalar fuel parameter h is provided as energy of a fuel per air volume and/or per air mass and/or per amount of substance of the air supply $\dot{V}_L$ in the case of stoichiometric portions of the fuel supply $\dot{V}_B$ and air supply $\dot{V}_L$.

In some embodiments, the burner appliance 1 comprising at least one air ratio sensor 20 and a regulating and/or controlling and/or monitoring facility 13 comprising a memory in which is stored at least one characteristic value 31, 32 comprising a minimum air requirement, and the method further comprises: ascertaining at least one air ratio signal 21 by the at least one air ratio sensor 20 and processing the at least one air ratio signal 21 to a value of an air ratio λ; ascertaining at least one air supply signal 14-16 that is a measurement for a value of the air supply $\dot{V}_L$ that is adjusted with the aid of the at least one air actuator 3, 4, and processing the at least one air supply signal 14-16 to a value of an air supply $\dot{V}_L$; ascertaining at least one fuel supply signal 17-19 that is a measurement for a value of a fuel supply $\dot{V}_B$ through the fuel supply duct 6 to the combustion chamber 2, said value being adjusted with the aid of the at least one fuel actuator 9, and processing the at least one fuel supply signal 17-19 to a value of a fuel supply $\dot{V}_B$; calculating a minimum air requirement 22 as a function of the value of the air supply $\dot{V}_L$ and as a function of the value of the fuel supply $\dot{V}_B$ and as a function of the value of the air ratio λ; comparing the calculated minimum air requirement 22 with the minimum air requirement of the at least one characteristic value 31, 32 that is stored in the memory of the regulating and/or controlling and/or monitoring facility 13; allocating a fuel group from the comparison of the calculated minimum air requirement 22 with the minimum air requirement of the at least one characteristic value 31, 32 that is stored in the memory of the regulating and/or controlling and/or monitoring facility 13; and providing the individual scalar fuel parameter h as a function of the allocated fuel group.

In some embodiments, the method further comprises ascertaining and/or predetermining the fuel parameter h as a function of the allocated fuel group.

In some embodiments, the at least one air ratio sensor 20 is arranged in the combustion chamber 2, and the method further comprises: ascertaining at least one air ratio signal 21 by the at least one air ratio sensor 20 in the combustion chamber 2; and processing the at least one air ratio signal 21 to a value of an air ratio λ.

In some embodiments, the at least one air ratio sensor 20 is arranged in an exhaust gas duct of the burner appliance 1, and the method further comprises: ascertaining at least one air ratio signal 21 by the at least one air ratio sensor 20 in the exhaust gas duct; and processing the at least one air ratio signal 21 to a value of an air ratio λ.

In some embodiments, the method further comprises: allocating a fuel from the comparison of the calculated minimum air requirement 22 with the minimum air requirement of the at least one characteristic value 31, 32 that is stored in the memory of the regulating and/or controlling and/or monitoring facility 13; and providing the individual scalar fuel parameter h as a function of the allocated fuel.

In some embodiments, the burner appliance 1 comprises at least one air ratio sensor 20 and a regulating and/or controlling and/or monitoring facility 13 comprising a memory in which is stored at least one characteristic value 31, 32 comprising a minimum air requirement, and the method further comprises: ascertaining at least one air ratio signal 21 by the at least one air ratio sensor 20, transmitting the at least one air ratio signal 21 to the regulating and/or controlling and/or monitoring facility 13 and processing the at least one air ratio signal 21 to a value of an air ratio λ by the regulating and/or controlling and/or monitoring facility 13; ascertaining at least one air supply signal 14-16, that is a measurement for a value of the air supply $\dot{V}_L$ through the air supply duct 11 to the combustion chamber 2, said value being adjusted with the aid of the at least one air actuator 3, 4, transmitting the at least one air supply signal 14-16 to the regulating and/or controlling and/or monitoring facility 13 and processing the at least one air supply signal 14-16 to a value of the air supply $\dot{V}_L$ by the regulating and/or controlling and/or monitoring facility 13; ascertaining at least one fuel supply signal 17-19, that is a measurement for a value of the fuel supply $\dot{V}_B$ through the fuel supply duct 6 to the combustion chamber 2, said value being adjusted with the aid of the at least one fuel actuator 9, transmitting the at least one fuel supply signal 17-19 to the regulating and/or controlling and/or monitoring facility 13 and processing the at least one fuel supply signal 17-19 to a value of the fuel supply $\dot{V}_B$ through the regulating and/or controlling and/or monitoring facility 13; calculating a minimum air requirement 22 as a function of the value of the air supply $\dot{V}_L$ and as a function of the value of the fuel supply $\dot{V}_B$ and as a function of the value of the air ratio λ by the regulating and/or controlling and/or monitoring facility 13; comparing by the regulating and/or controlling and/or monitoring facility 13 the calculated minimum air requirement 22 with the minimum air requirement of the at least one characteristic value 31, 32, said value being stored in the memory of the regulating and/or controlling and/or monitoring facility 13; allocating by the regulating and/or controlling and/or monitoring facility 13 a fuel group from the comparison of the calculated minimum air requirement 22 with the minimum air requirement of the at least one characteristic value 31, 32 that is stored in the memory of the regulating and/or controlling and/or monitoring facility 13; and providing the individual scalar fuel parameter h as a function of the allocated fuel group by the regulating and/or controlling and/or monitoring facility 13.

In some embodiments, the air supply duct 11 leads directly to the combustion chamber 2 and the fuel supply duct 6 leads directly to the combustion chamber 2, and the method further comprises: ascertaining at least one air supply signal 14-16 that is a measurement for a value of the air supply $\dot{V}_L$ through the air supply duct 11 directly to the combustion chamber 2, said value being adjusted with the aid of the at least one air actuator 3, 4, and processing the at least one air supply signal 14-16 to a value of the air supply $\dot{V}_L$; and ascertaining at least one fuel supply signal 17-19 that is a measurement for a value of a fuel supply $\dot{V}_B$ through the fuel supply duct 6 directly to the combustion chamber 2, said value being adjusted with the aid of the at least one fuel actuator 9, and processing the at least one fuel supply signal 17-19 to a value of the fuel supply $\dot{V}_B$.

In some embodiments, the air supply duct 11 is connected to the combustion chamber 2. In particular, the air supply duct 11 can be directly connected to the combustion chamber 2 and/or can lead directly to the combustion chamber 2.

In some embodiments, the fuel supply duct 6 is connected to the combustion chamber 2. In particular, the fuel supply duct 6 can be directly connected to the combustion chamber 2 and/or can lead directly to the combustion chamber 2.

In some embodiments, the air supply duct 11 and the fuel supply duct 6 lead to the combustion chamber 2, and the air supply duct 11 and the fuel supply duct 6 issue upstream of the combustion chamber 2 into a common mixture feed that leads to the combustion chamber 2, and the method further comprises ascertaining at least one fuel supply signal 17-19.

In some embodiments, the air supply duct 11 and the fuel supply duct 6 issue upstream of the combustion chamber 2 into a common mixture feed that leads to the combustion chamber 2, and the method further comprises: ascertaining at least one air supply signal 14-16 that is a measurement for a value of the air supply $\dot{V}_L$ through the air supply duct 11 to the common mixture feed, said value being adjusted with the aid of the at least one air actuator 3, 4, and processing the at least one air supply signal 14-16 to a value of the air supply $\dot{V}_L$; and ascertaining at least one fuel supply signal 17-19 that is a measurement for a value of a fuel supply $\dot{V}_B$ through the fuel supply duct 6 to the common mixture feed, said value being adjusted with the aid of the at least one fuel actuator 9, and processing the at least one fuel supply signal 17-19 to a value of the fuel supply $\dot{V}_B$.

In some embodiments, the air supply duct 11 is connected to the combustion chamber 2 but issues upstream of the combustion chamber having the fuel supply duct 6 into a common mixture feed that leads to the burner and/or the combustion chamber 2. Furthermore, the fuel supply duct 6 is connected to the combustion chamber 2 but issues upstream of the combustion chamber having the air supply duct 6 into a common mixture feed that leads to the burner and/or the combustion chamber 2.

In some embodiments, the burner appliance 1 comprises the previously mentioned mixture feed in particular the previously mentioned common mixture feed. The previously mentioned mixture feed leads directly to the combustion chamber 2. The previously mentioned mixture feed may be different to the combustion chamber 2. The common mixture feed leads directly to the combustion chamber 2. The common mixture feed may be different to the combustion chamber 2.

In some embodiments, the at least one characteristic value 31, that is stored in the memory of the regulating and/or controlling and/or monitoring facility 13 comprises a minimum air requirement in the form of a limit value 31, 32; the limit value 31, 32 delimits values of the minimum air requirement of a first and a second fuel group from one another; and the method further comprises allocating the calculated minimum air requirement 22 to the first or to the second fuel group with the aid of the limit value 31, 32 of the at least one characteristic value 31, 32 that is stored in the regulating and/or controlling and/or monitoring facility 13.

In some embodiments, the at least one characteristic value 31, that is stored in the memory of the regulating and/or controlling and/or monitoring facility 13 comprises a minimum air requirement in the form of a limit value 31, 32; the limit value 31, 32 delimits values of the minimum air requirement of a first and a second fuel from one another; and the method comprises allocating the calculated minimum air requirement 22 to the first or to the second fuel with the aid of the limit value 31, 32 of the at least one characteristic value 31, 32 that is stored in the regulating and/or controlling and/or monitoring facility 13.

In some embodiments, the step of calculating a minimum air requirement 22 as a function of the value of the air supply $\dot{V}_L$ and as a function of the value of the fuel supply $\dot{V}_B$ and as a function of the value of the air ratio $\lambda$ comprises calculating the minimum air requirement as a quotient from the value of the air supply $\dot{V}_L$ and a product from the value of the fuel supply $\dot{V}_B$ and from the value of the air ratio $\lambda$.

In some embodiments, the at least one air actuator 3, 4 comprises a blower 3 having an adjustable rotational speed and the blower 3 is configured to receive a control signal 15 that is directed to the blower and to adjust its rotational speed according to the control signal 15; and the step of ascertaining at least one air supply signal 14-16 that is a measurement for a value of the air supply $\dot{V}_L$ through the air supply duct 11 to the combustion chamber 2, said value being adjusted with the aid of the at least one air actuator 3, 4, comprises ascertaining at least one control signal 15 that is directed to the blower 3 and/or at least one rotational speed signal that is reported back by the blower 3, said control signal and/or rotational speed signal being a measurement for a value of an air supply $\dot{V}_L$ through the air supply duct 11 to the combustion chamber 2, said value being adjusted with the aid of the at least one air actuator 3, 4.

In some embodiments, the at least one air actuator 3, 4 comprises a blower 3 having an adjustable rotational speed and the blower 3 is configured to receive a control signal 15 that is directed to the blower and to adjust its rotational speed according to the control signal 15; and the step of ascertaining at least one air supply signal 14-16 that is a measurement for a value of the air supply $\dot{V}_L$ through the air supply duct 11 preferably directly to the combustion chamber 2, said value being adjusted with the aid of the at least one air actuator 3, 4, comprises ascertaining at least one control signal 15 that is directed to the blower 3 and/or at least one rotational speed signal that is reported back, said control signal and/or rotational speed signal being a measurement for a value of an air supply $\dot{V}_L$ through the air supply duct 11 to the combustion chamber 2, said value being adjusted with the aid of the at least one air actuator 3, 4.

In some embodiments, there is a computer program product comprising commands that, in the case of implementing the program by a computer, cause said computer to perform the steps of one of the previously mentioned methods. In some embodiments, there is a computer program comprising commands that, in the case of implementing the program by a computer, cause said computer to perform the steps of one of the previously mentioned methods.

In some embodiments, a computer program product comprises commands that in the case of implementing the program by a regulating and/or controlling and/or monitoring facility 13 for a burner appliance 1 comprising at least one fuel actuator 9 and at least one air actuator 3, 4 cause the regulating and/or controlling and/or monitoring facility 13: to calculate an actual value $P_{ist}$ of a power output of the burner appliance 1 from a measured and/or predetermined value of the air supply $\dot{V}_L$, a measured and/or predetermined value of the air ratio $\lambda$ and an individual scalar fuel parameter h in accordance with $$P_{ist} = \frac{h}{\lambda} \cdot \dot{V}_L;$$

and to regulate the burner appliance 1 with the aid of the at least one fuel actuator 9 and of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a computer program product comprises commands that in the case of implementing the program by a regulating and/or controlling and/or monitoring facility 13 of a burner appliance 1 comprising at least one fuel actuator 9 and at least one air actuator 3, 4 cause the regulating and/or controlling and/or monitoring facility 13: to calculate an actual value $P_{ist}$ of a power output of the burner appliance 1 from a measured and/or predetermined value of the air supply $\dot{V}_L$, a measured and/or predetermined value of the air ratio $\lambda$ and an individual scalar fuel parameter h in accordance with $$P_{ist} = \frac{h}{\lambda} \cdot \dot{V}_L;$$

and to regulate the burner appliance 1 with the aid of the at least one fuel actuator 9 and with the aid of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a computer program product comprises commands that in the case of implementing the program by a regulating and/or controlling and/or monitoring facility 13 for a burner appliance 1 comprising at least one fuel actuator 9 and at least one air actuator 3, 4 cause the regulating and/or controlling and/or monitoring facility 13: to predetermine and/or measure a value of an air supply $\dot{V}_L$ through the air supply duct 11; to predetermine and/or measure a value of an air ratio λ; to provide an individual scalar fuel parameter h; to calculate an actual value $P_{ist}$ of a power output of the burner appliance 1 from the measured and/or predetermined value of the air supply $\dot{V}_L$, the measured and/or predetermined value of the air ratio λ and the individual scalar fuel parameter h in accordance with $$P_{ist} = \frac{h}{\lambda} \cdot \dot{V}_L;$$

and to regulate the burner appliance 1 with the aid of the at least one fuel actuator 9 and preferably of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a computer program product comprises commands that in the case of implementing the program by a regulating and/or controlling and/or monitoring facility 13 of a burner appliance 1 comprising at least one fuel actuator 9 and at least one air actuator 3, 4 cause the regulating and/or controlling and/or monitoring facility 13: to predetermine and/or measure a value of an air supply $\dot{V}_L$ through the air supply duct 11; to predetermine and/or measure a value of an air ratio λ; to provide an individual scalar fuel parameter h; to calculate an actual value $P_{ist}$ of a power output of the burner appliance 1 from the measured and/or predetermined value of the air supply $\dot{V}_L$, the measured and/or predetermined value of the air ratio λ and the individual scalar fuel parameter h in accordance with $$P_{ist} = \frac{h}{\lambda} \cdot \dot{V}_L;$$

and to regulate the burner appliance 1 with the aid of the at least one fuel actuator 9 and of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a non-volatile computer-readable memory storage medium stores a set of commands for implementation by at least one regulating and/or controlling and/or monitoring facility 13 for a burner appliance 1, the burner appliance 1 comprising at least one fuel actuator 9 and at least one air actuator 3, 4, which if the set of commands is implemented by the regulating and/or controlling and/or monitoring facility 13: calculates an actual value $P_{ist}$ of a power output of the burner appliance 1 from a measured and/or predetermined value of the air supply $\dot{V}_L$, a measured and/or predetermined value of the air ratio λ and an individual scalar fuel parameter h in accordance with $$P_{ist} = \frac{h}{\lambda} \cdot \dot{V}_L;$$

and regulates the burner appliance 1 with the aid of the at least one fuel actuator 9 and of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a non-volatile computer-readable memory storage medium stores a set of commands for implementation by at least one regulating and/or controlling and/or monitoring facility 13 of a burner appliance 1, the burner appliance 1 comprising at least one fuel actuator 9 and at least one air actuator 3, 4, which if the set of commands is implemented by the regulating and/or controlling and/or monitoring facility 13: calculates an actual value $P_{ist}$ of a power output of the burner appliance 1 from a measured and/or predetermined value of the air supply $\dot{V}_L$, a measured and/or predetermined value of the air ratio λ and an individual scalar fuel parameter h in accordance with $$P_{ist} = \frac{h}{\lambda} \cdot \dot{V}_L;$$

and regulates the burner appliance 1 with the aid of the at least one fuel actuator 9 and of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a non-volatile computer-readable memory storage medium stores a set of commands for implementation by at least one regulating and/or controlling and/or monitoring facility 13 for a burner appliance 1, the burner appliance 1 comprising at least one fuel actuator 9 and at least one air actuator 3, 4, which if the set of commands is implemented by the regulating and/or controlling and/or monitoring facility 13: predetermines and/or measures a value of an air supply $\dot{V}_L$ through the air supply duct 11; predetermines and/or measures a value of an air ratio λ; provides an individual scalar fuel parameter h; calculates an actual value $P_{ist}$ of a power output of the burner appliance 1 from the measured and/or predetermined value of the air supply $\dot{V}_L$, the measured and/or predetermined value of the air ratio λ and the individual scalar fuel parameter h in accordance with $$P_{ist} = \frac{h}{\lambda} \cdot \dot{V}_L;$$

and regulates the burner appliance 1 with the aid of the at least one fuel actuator 9 and of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a non-volatile computer-readable memory storage medium stores a set of commands for implementation by at least one regulating and/or controlling and/or monitoring facility 13 of a burner appliance 1, the burner appliance 1 comprising at least one fuel actuator 9 and at least one air actuator 3, 4, which if the set of commands is implemented by the regulating and/or controlling and/or monitoring facility 13: predetermines and/or measures a value of an air supply $\dot{V}_L$ through the air supply duct 11; predetermines and/or measures a value of an air ratio λ; provides an individual scalar fuel parameter h; calculates an actual value $P_{ist}$ of a power output of the burner appliance 1 from the measured and/or predetermined value of the air supply $\dot{V}_L$, the measured and/or predetermined value of the air ratio λ and the individual scalar fuel parameter h in accordance with $$P_{ist} = \frac{h}{\lambda} \cdot \dot{V}_L;$$

and regulates the burner appliance 1 with the aid of the at least one fuel actuator 9 and of the at least one air actuator 3, 4 in dependence upon the actual value $P_{ist}$ of the power output of the burner appliance 1 and in dependence upon a target value $P_{soll}$ of the power output of the burner appliance 1 until the target value $P_{soll}$ of the power output of the burner appliance 1 is achieved.

In some embodiments, a non-volatile computer-readable memory storage medium stores a set of commands for implementation by at least one processor that performs the steps of one of the previously mentioned methods if the set of commands is implemented by a processor.

In some embodiments, a burner appliance 1 comprises a combustion chamber 2, an air supply duct 11 that leads to the combustion chamber 2 and comprises at least one air actuator 3, 4 that is configured to adjust a value of an air supply $\dot{V}_L$ through the air supply duct 11, and a fuel supply duct 6 that leads to the combustion chamber 2 and comprises at least one fuel actuator 9 that is configured to adjust a value of a fuel supply $\dot{V}_B$ through the fuel supply duct 6, and the burner appliance 1 includes means for performing one of the previously mentioned methods for regulating the burner appliance 1.

In some embodiments, there is a burner appliance 1 comprising a combustion chamber 2, an air supply duct 11 that leads to the combustion chamber 2 and comprises at least one air actuator 3, 4 that is configured to adjust a value of an air supply $\dot{V}_L$ through the air supply duct 11, and a fuel supply duct 6 that leads to the combustion chamber 2 and comprises at least one fuel actuator 9 that is configured to adjust a value of a fuel supply $\dot{V}_B$ through the fuel supply duct 6, the burner appliance 1 moreover comprising a regulating and/or controlling and/or monitoring facility 13 for performing one of the previously mentioned methods for regulating the burner appliance 1.

In some embodiments, the regulating and/or controlling and/or monitoring facility 13 is communicatively connected to the at least one air actuator 3, 4 and/or communicatively connected to the at least one fuel actuator 9.

In some embodiments, there is a burner appliance 1 comprising a combustion chamber 2, comprising at least one air ratio sensor 20, an air supply duct 11 that leads to the combustion chamber 2 and comprises at least one air actuator 3, 4 that is configured to adjust a value of an air supply $\dot{V}_L$ through the air supply duct 11, and a fuel supply duct 6 that leads to the combustion chamber 2 and comprises at least one fuel actuator 9 that is configured to adjust a value of a fuel supply $\dot{V}_B$ through the fuel supply duct 6, the burner appliance 1 moreover comprising a regulating and/or controlling and/or monitoring facility 13 for performing one of the previously mentioned methods comprising ascertaining at least one fuel supply signal 17-19.

In some embodiments, the regulating and/or controlling and/or monitoring facility 13 is communicatively connected to the at least one air ratio sensor 20.

In some embodiments, the burner appliance 1 comprises a combustion chamber 2, a regulating and/or controlling and/or monitoring facility 13 comprising a memory in which is stored at least one characteristic value 31, 32 comprising a minimum air requirement 22, at least one air ratio sensor 20 for ascertaining the air ratio λ, an air supply duct 11 that leads to the combustion chamber 2 and comprises at least one air actuator 3, 4 that is configured to adjust a value of an air supply $\dot{V}_L$ through the air supply duct 11, and a fuel supply duct 6 that leads to the combustion chamber 2 and comprises at least one fuel actuator 9 that is configured to adjust a value of a fuel supply $\dot{V}_B$ through the fuel supply duct 6, and the method further comprises: ascertaining at least one air ratio signal 21 by the at least one air ratio sensor 20 for ascertaining the air ratio λ and processing the at least one air ratio signal 21 to a value of an air ratio λ; ascertaining at least one air supply signal 14-16 that is a measurement for a value of the air supply $\dot{V}_L$ through the air supply duct 11 to the combustion chamber 2, said value being adjusted with the aid of the at least one air actuator 3, 4, and processing the at least one air supply signal 14-16 to a value of an air supply $\dot{V}_L$; ascertaining at least one fuel supply signal 19 that is a measurement for a value of a fuel supply $\dot{V}_B$ through the fuel supply duct 6 to the combustion chamber 2, said value being adjusted with the aid of the at least one fuel actuator 9, and processing the at least one fuel supply signal 17-19 to a value of a fuel supply $\dot{V}_B$; calculating a minimum air requirement 22 as a function of the value of the air supply $\dot{V}_L$ and as a function of the value of the fuel supply $\dot{V}_B$ and as a function of the value of the air ratio λ; comparing the calculated minimum air requirement 22 with the minimum air requirement of the at least one characteristic value 31, 32 that is stored in the memory of the regulating and/or controlling and/or monitoring facility 13; and allocating a fuel group from the comparison of the calculated minimum air requirement 22 with the minimum air requirement of the at least one characteristic value 31, 32 that is stored in the memory of the regulating and/or controlling and/or monitoring facility 13.

In some embodiments, air ratio sensor 20 for ascertaining the air ratio λ is or comprises an air ratio sensor 20 for ascertaining the air ratio λ in the combustion chamber 2 of the burner appliance 1. In some embodiments, the step of ascertaining at least one air ratio signal 13 by the at least one air ratio sensor 20 for ascertaining the air ratio λ includes ascertaining at least one air ratio signal 21 by the at least one air ratio sensor 20 for ascertaining the air ratio λ in the combustion chamber 2.

In some embodiments, the method further comprises ascertaining at least one air supply signal 14-16 that is a direct measurement for a value of the air supply $\dot{V}_L$ to the combustion chamber 2, said value being adjusted with the aid of the at least one air actuator 3, 4.

In some embodiments, the method further comprises ascertaining at least one air supply signal 14-16 that is a direct and/or proportional measurement for a value of the air supply $\dot{V}_L$ through the air supply duct 11 to the combustion chamber 2, said value being adjusted with the aid of the at least one air actuator 3, 4, and processing the at least one air supply signal 14-16 to a value of an air supply $\dot{V}_L$.

In some embodiments, the method further comprises ascertaining at least one fuel supply signal 19 that is a direct measurement for a value of the fuel supply $\dot{V}_B$ to the combustion chamber 2, said value being adjusted with the aid of the at least one fuel actuator 9.

In some embodiments, the method include ascertaining at least one fuel supply signal 19 that is a direct and/or proportional measurement for a value of a fuel supply $\dot{V}_B$ through the fuel supply duct 6 directly to the combustion chamber 2, said value being adjusted with the aid of the at least one fuel actuator 9, and processing the at least one fuel supply signal 17-19 to a value of a fuel supply $\dot{V}_B$.

In some embodiments, the method further comprises: determining a fuel parameter h as a function of the allocated fuel group; and determining an actual value $P_{ist}$ of the power output of the burner appliance 1 as a function of the fuel parameter h, of the value of an air ratio λ and of the value of an air supply $\dot{V}_L$. In particular, it is possible to provide that the individual scalar fuel parameter h is determined as a function of the allocated fuel group with the aid of a table that is stored in the memory of the regulating and/or controlling and/or monitoring facility 13. Moreover, it is possible to provide that the actual value $P_{ist}$ of the power output of the burner appliance 1 is determined as a function of the fuel parameter h, of the value of an air ratio λ and of the value of an air supply $\dot{V}_L$. In particular, it is possible to provide that an actual value $P_{ist}$ of the power output of the burner appliance 1 is determined as a function of the fuel parameter h, of the value of an air ratio λ and of the value of an air supply $\dot{V}_L$.

In some embodiments, the method further comprises: receiving a power output request signal and processing the power output request signal to a target value of a power output $P_{soll}$ of the burner appliance 1 and regulating the actual value $P_{ist}$ of the power output of the burner appliance 1 with the aid of at least one actuator selected from:

the at least one fuel actuator 9 and the at least one air actuator 3, 4 to the target value $P_{soll}$ of the power output of the burner appliance 1.

In some embodiments, the method further comprises receiving a power output request signal by the regulating and/or controlling and/or monitoring facility 13 and processing the power output request signal to a target value of a power output $P_{soll}$ of the burner appliance 1 by the regulating and/or controlling and/or monitoring facility 13.

In some embodiments, the method further comprises: receiving a power output request signal that has been generated by an energy regulating facility and/or by a temperature regulating facility by the regulating and/or controlling and/or monitoring facility 13; and processing the power output request signal to a target value $P_{soll}$ of the power output of the burner appliance 1 by the regulating and/or controlling and/or monitoring facility 13.

In some embodiments, the method further comprises regulating the actual value $P_{ist}$ of the power output of the burner appliance 1 with the aid of at least one variable selected from:

the fuel supply $\dot{V}_B$ through the fuel supply duct 6 and the air supply $\dot{V}_L$ through the air supply duct 11 to the target value $P_{soll}$ of the power output of the burner appliance 1.

In some embodiments, the method further comprises: comparing the target value $P_{soll}$ of the power output of the burner appliance 1 having a predetermined maximum power output $P_{max}$ of the burner appliance 1; and delimiting the target value $P_{soll}$ of the power output of the burner appliance 1 to the predetermined maximum power output $P_{max}$ of the burner appliance 1 if the target value $P_{soll}$ of the power output of the burner appliance 1 is greater than the predetermined maximum power output $P_{max}$ of the burner appliance 1.

In some embodiments, the method further comprises: comparing the target value of the power output $P_{soll}$ of the burner appliance 1 with a predetermined minimum power output $P_{min}$ of the burner appliance 1; and delimiting the target value $P_{soll}$ of the power output of the burner appliance 1 to the predetermined minimum power output $P_{min}$ of the burner appliance 1 if the target value $P_{soll}$ of the power output of the burner appliance 1 is less than the predetermined minimum power output $P_{min}$ of the burner appliance 1.

In some embodiments, the method further comprises: determining a maximum fuel supply $\dot{V}_{Bmax}$ of the burner appliance 1 with the aid of a predetermined maximum power output $P_{max}$ of the burner appliance 1 and with the aid of a predetermined calorific value $H_U$; comparing a fuel supply $\dot{V}_B$ of the burner appliance 1 with the maximum fuel supply $\dot{V}_{Bmax}$ of the burner appliance 1; and delimiting the fuel supply $\dot{V}_B$ of the burner appliance 1 to the maximum fuel supply $\dot{V}_{Bmax}$ of the burner appliance 1 if the fuel supply $\dot{V}_B$ of the burner appliance 1 is greater than the maximum fuel supply $\dot{V}_{Bmax}$ of the burner appliance 1.

In some embodiments, the method further comprises: ascertaining a calorific value $H_U$ and a maximum fuel supply $\dot{V}_{Bmax}$ with the aid of a predetermined maximum output power $P_{max}$ of the burner appliance 1 and by means of a previously described determined minimum air requirement $L_{min}$ and with the aid of the fuel parameter h; and comparing a fuel supply $\dot{V}_B$ of the burner appliance 1 with the maximum fuel supply $\dot{V}_{Bmax}$ of the burner appliance 1; and delimiting the fuel supply $\dot{V}_B$ of the burner appliance 1 to the maximum fuel supply $\dot{V}_{Bmax}$ of the burner appliance 1 if the fuel supply $\dot{V}_B$ of the burner appliance 1 is greater than the maximum fuel supply $\dot{V}_{Bmax}$ of the burner appliance 1.

In some embodiments, the method further comprises: determining a minimum fuel supply $\dot{V}_{Bmin}$ of the burner appliance 1 with the aid of a predetermined minimum power output $P_{min}$ of the burner appliance 1 and with the aid of a predetermined calorific value $H_U$ by means of a previously described determined minimum air requirement $L_{min}$ and with the aid of the fuel parameter h; and comparing a fuel supply $\dot{V}_B$ of the burner appliance 1 with the minimum fuel supply $\dot{V}_{Bmin}$ of the burner appliance 1; and delimiting and/or increasing the fuel supply $\dot{V}_B$ of the burner appliance 1 to the minimum fuel supply $\dot{V}_{Bmin}$ of the burner appliance 1 if the fuel supply $\dot{V}_B$ of the burner appliance 1 is less than the minimum fuel supply $\dot{V}_{Bmin}$ of the burner appliance 1.

In some embodiments, the method further comprises: ascertaining a calorific value $H_U$ and a minimum fuel supply $\dot{V}_{Bmin}$ of the burner appliance 1 with the aid of a predetermined minimum output power $P_{min}$ of the burner appliance 1 and by means of a previously described determined minimum air requirement $L_{min}$ and with the aid of the fuel parameter h; and comparing a fuel supply $\dot{V}_B$ of the burner appliance 1 with the minimum fuel supply $\dot{V}_{Bmin}$ of the burner appliance 1; and delimiting and/or increasing the fuel supply $\dot{V}_B$ of the burner appliance 1 to the minimum fuel supply $\dot{V}_{Bmin}$ of the burner appliance 1, if the fuel supply $\dot{V}_B$ of the burner appliance 1 is less than the minimum fuel supply $\dot{V}_{Bmin}$. In some embodiments, the method further comprises adjusting the fuel supply $\dot{V}_B$ by way of a predetermined function of a control signal 19 for the at least fuel actuator 9.

In some embodiments, the method further comprises determining the converted energy of the burner appliance 1 within a time interval in which the actual values $P_{ist}$ of the power output of the burner appliance 1 that are calculated by way of one of the previously mentioned methods are integrated over time within the time interval.

In some embodiments, the method further comprises: calculating actual values $P_{ist}$ of the power output of the burner appliance 1 in sequential predetermined time intervals within a time interval with the aid of one of the previously mentioned methods; calculating a converted energy within each time interval by multiplying the respective time interval and the calculated actual values $P_{ist}$ of the power output of the burner appliance 1; and totaling within the time interval the energies that are converted within the sequential predetermined time intervals.

In some embodiments, the method further comprises: calculating the converted energy of the burner appliance 1 of a time interval that comprises multiple individual sub-intervals in that a converted energy is calculated for each of the multiple individual sub-intervals; and totaling the converted energies that are calculated at the multiple individual sub-intervals to form a total converted energy of the burner appliance 1.

In some embodiments, within a time interval the individual scalar fuel parameter h of a fuel composition is known, the method further comprises: calculating the actual values $P_{ist}$ of the power output of the burner appliance 1 within the time interval with the aid of the known fuel parameter h; and calculating a total converted energy of the burner appliance 1 by the integration of the calculated actual values $P_{ist}$ of the power output of the burner appliance 1 over the time interval.

In some embodiments, the method further comprises: determining the fuel parameter h in sequential known time intervals within a time interval with the aid of one of the previously mentioned methods; calculating the actual value $P_{ist}$ of the power output of the burner appliance 1 for a respective fuel composition; calculating a converted energy within each time interval by multiplying the respective time interval and the calculated actual value $P_{ist}$ of the power output of the burner appliance 1; and totaling within the time interval the energies that are converted within the sequential predetermined time intervals.

In some embodiments, the method further comprises setting the calculated actual value $P_{ist}$ of the power output of the burner appliance 1 to zero if the fuel supply 6 is interrupted by a safety shut-off valve 7, 8.

In some embodiments, the burner appliance 1 comprises a safety shut-off valve 7, 8.

In some embodiments, the time interval is a heating period of one year. In some embodiments, the time interval is a total previous operating duration from the start of operating the burner appliance 1 until the current time value. The time interval may be a billing time period of a fuel supplier.

In some embodiments, the method further comprises determining the costs such as for example consumption costs over a time interval by multiplying predetermined costs per energy unit by the converted energy during the time interval.

In some embodiments, the at least one characteristic value 31, that is stored in the memory of the regulating and/or controlling and/or monitoring facility 13 comprises a minimum air requirement 22 in the form of a limit value 31; 32; wherein the limit value 31, 32 delimits values of the minimum air requirement of a first and a second fuel group from one another; and the step of evaluating a fuel group from the comparison of the calculated minimum air requirement 22 with the minimum air requirement of the at least one characteristic value 31, 32 that is stored in the memory of the regulating and/or controlling and/or monitoring facility 13 comprises allocating the calculated minimum air requirement 22 to the first or to the second fuel group with the aid of the limit value 31, 32 of the at least one characteristic value 31, 32 that is stored in the regulating and/or controlling and/or monitoring facility 13.

In some embodiments, the at least one characteristic value 31, that is stored in the memory of the regulating and/or controlling and/or monitoring facility 13 comprises a minimum air requirement 22 and a concentration of a base gas; and the step of evaluating a fuel group from the comparison of the calculated minimum air requirement 22 with the minimum air requirement of the characteristic value 31, 32 that is stored in the memory of the regulating and/or controlling and/or monitoring facility 13 comprises allocating the calculated minimum air requirement 22 so as to concentrate a base gas of the at least one characteristic value 31, 32 that is stored in the regulating and/or controlling and/or monitoring facility 13.

In some embodiments, the at least one characteristic value 31, that is stored in the memory of the regulating and/or controlling and/or monitoring facility 13 comprises a minimum air requirement 22 and a concentration of a base gas; wherein at least one further characteristic value 31, 32 comprising a minimum air requirement and a concentration of a base gas is stored in the memory of the regulating and/or controlling and/or monitoring facility 13, the method further comprising: determining a first interval of the calculated minimum air requirement 22 from the minimum air requirement of the at least one characteristic value 31, 32 that is stored in the memory of the regulating and/or controlling and/or monitoring facility 13; determining a second interval of the calculated minimum air requirement 22 from the minimum air requirement of the at least one further characteristic value 31, 32 that is stored in the memory of the regulating and/or controlling and/or monitoring facility 13; and mapping the calculated minimum air requirement 22 with respect to a concentration of a base gas as a function of the first interval and the second interval and the concentration of a base gas of the at least one characteristic value 31, 32 and the concentration of a base gas of the at least one further characteristic value 31, 32.

In some embodiments, the step of mapping the calculated minimum air requirement 22 with respect to a concentration of a base gas as a function of the first interval and the second interval and the concentration of a base gas of the at least one characteristic value 31, 32 and the concentration of a base gas of the at least one further characteristic value 31, 32 comprises an interpolation between the at least one characteristic value 31, 32 and the at least one further characteristic value 31, 32.

In some embodiments, the step of mapping the calculated minimum air requirement 22 with respect to a concentration of a base gas as a function of the first interval and the second interval and the concentration of a base gas of the at least one characteristic value 31, 32 and the concentration of a base gas of the at least one further characteristic value 31, 32 comprises determining the smallest interval from the first and the second interval.

In some embodiments, the step of calculating a minimum air requirement as a function of the value of the air supply $\dot{V}_L$ and as a function of the value of the fuel supply $\dot{V}_B$ and as a function of the value of the air ratio λ comprises: calculating a quotient from the value of the air supply $\dot{V}_L$ and a product from the value of the fuel supply $\dot{V}_B$ and from the value of the air ratio λ; and outputting the calculated quotient as a calculated minimum air requirement.

In some embodiments, the step of calculating a minimum air requirement as a function of the value of the air supply $\dot{V}_L$ and as a function of the value of the fuel supply $\dot{V}_B$ and as a function of the value of the air ratio A comprises determining and/or calculating a quotient from the value of the air supply $\dot{V}_L$ and the value of the fuel supply $\dot{V}_B$.

In some embodiments, the step of calculating a minimum air requirement as a function of the value of the air supply $\dot{V}_L$ and as a function of the value of the fuel supply $\dot{V}_B$ and as a function of the value of the air ratio λ comprises determining and/or calculating a quotient from the value of the air supply $\dot{V}_L$ and the value of the air ratio λ.

In some embodiments, the step of calculating a minimum air requirement as a function of the value of the air supply $\dot{V}_L$ and as a function of the value of the fuel supply $\dot{V}_B$ and as a function of the value of the air ratio λ comprises determining and/or calculating a product from the value of the fuel supply $\dot{V}_B$ and the value of the air ratio λ.

In some embodiments, the at least one air actuator comprises a blower 3 having an adjustable rotational speed and the blower 3 is configured to receive a control signal 15 that is directed to the blower and to adjust its rotational speed according to the control signal 15; and the step of ascertaining at least one air supply signal 14-16 that is a measurement for a value of the air supply $\dot{V}_L$ through the air supply duct 11 to the combustion chamber 2, for example directly to the combustion chamber 2, said value being adjusted with the aid of the at least one air actuator 3, 4, comprises ascertaining at least one control signal 15 that is directed to the blower 3 and is a measurement for a value of an air supply $\dot{V}_L$ through the air supply duct 11 to the combustion chamber 2, for example directly to the combustion chamber 2, said value being adjusted with the aid of the at least one air actuator 3, 4.

In some embodiments, the burner appliance 1 comprises at least one mass flow sensor 12 that is arranged in the air supply duct 11 or is in fluid connection with the air supply duct 11; the step of ascertaining at least one air supply signal 14-16 that is a measurement for a value of the air supply $\dot{V}_L$ through the air supply duct 11 to the combustion chamber 2, for example directly to the combustion chamber 2, said value being adjusted with the aid of the at least one air actuator 3, 4, comprises: ascertaining at least one signal 16 by the at least one mass flow sensor 12, said signal being a measurement for the value of the air supply $\dot{V}_L$ through the air supply duct 11 to the combustion chamber 2, for example directly to the combustion chamber 2, said value being adjusted with the aid of the at least one air actuator 3, 4; and processing the at least one air supply signal 16 to the measured value of the air supply $\dot{V}_L$.

In some embodiments, the control signal 15 that is directed to the blower 3 is a pulse width modulated signal. In some embodiments, the control signal 15 that is directed to the blower 3 is a signal from a converter. In some embodiments, the burner appliance 1 comprises a converter and the control signal 15 that is directed to the blower 3 is a signal from the converter of the burner appliance 1.

The regulating and/or controlling and/or monitoring facility 13 is communicatively connected to the blower 3.

In some embodiments, the step of ascertaining at least one air supply signal 14-16 that is a measurement for a value of the air supply $\dot{V}_L$ through the air supply duct 11, said value being adjusted with the aid of the at least one air actuator 3, 4, comprises ascertaining at least one signal that is reported by the blower 3 back to the regulating, controlling and monitoring facility 13, wherein at least one signal is a measurement for a value of an air supply $\dot{V}_L$ through the air supply duct 11, said value being adjusted with the aid of the at least one air actuator 3, 4.

In some embodiments, the signal that is reported back has a rotational speed-dependent frequency, and the method further comprises ascertaining at least one signal that is reported by the blower 3 back to the regulating, controlling and monitoring facility 13, wherein the rotational speed-dependent frequency is a measurement for a value of an air supply $\dot{V}_L$ through the air supply duct 11, said value being adjusted with the aid of the at least one air actuator 3, 4.

In some embodiments, the burner appliance 1 comprises at least one mass flow sensor 12 that is arranged in the air supply duct 11; and the step of ascertaining at least one air supply signal 14-16 that is a measurement for a value of the air supply $\dot{V}_L$ through the air supply duct 11 to the combustion chamber 2, for example directly to the combustion chamber 2, said value being adjusted with the aid of the at least one air actuator 3, 4, comprises ascertaining at least one signal 16 by the at least one mass flow sensor 12, said signal being a measurement for a value of the air supply $\dot{V}_L$ through the air supply duct 11 to the combustion chamber 2, for example directly to the combustion chamber 2, said value being adjusted with the aid of the at least one air actuator 3, 4.

In some embodiments, the mass flow sensor is communicatively connected to the regulating and/or controlling and/or monitoring facility 13.

In some embodiments, the burner appliance 1 comprises at least one mass flow sensor 12 that is arranged in the air supply duct 11; and the step of ascertaining at least one air supply signal 14-16 that is a measurement for a value of the air supply $\dot{V}_L$ through the air supply duct 11, said value being adjusted with the aid of the at least one air actuator 3, 4, comprises ascertaining at least one signal 16 by the at least one mass flow sensor 12 and at least one signal 14, 15 by the at least one actuator 3, 4, said signals being in each case a measurement for the air supply $\dot{V}_L$ through the air supply duct 11, said value being adjusted with the aid of the at least one air actuator 3, 4.

In some embodiments, the method further comprises ascertaining a measurement for the value of the air supply $\dot{V}_L$ through the air supply duct 11 from the at least one ascertained signal 16 of the mass flow sensor 12 and the at least one signal 14, 15 of the actuators 3, 4.

In some embodiments, the at least one air ratio sensor 20 for ascertaining the air ratio λ comprises a λ sensor and/or is a λ sensor.

In some embodiments, the at least one air ratio sensor 20 for ascertaining the air ratio λ comprises an oxygen sensor and/or is an oxygen sensor. In particular, the air ratio sensor 20 for ascertaining the air ratio λ can be an oxygen sensor on a zirconium dioxide base ($ZrO_2$) or can comprise an oxygen sensor on a zirconium dioxide base ($ZrO_2$).

In some embodiments, the at least one fuel actuator 9 comprises a fuel flap having a control element for adjusting a flap position and is configured to receive a control signal 19 that is directed to the control element of the fuel flap and with the aid of the control element to adjust its flap positioning according to the control signal 19; and the step of ascertaining at least one fuel supply signal 17-19 that is a measurement for a value of a fuel supply $\dot{V}_B$ through the fuel supply duct 6 to the combustion chamber 2, for example directly to the combustion chamber 2, said value being adjusted with the aid of the at least one fuel actuator 9, comprises ascertaining at least one control signal 19 that is directed to the control element of the fuel flap and is a measurement for a fuel supply $\dot{V}_B$, said value being adjusted with the aid of the at least one fuel actuator 9.

In some embodiments, the control signal 19 that is directed to the control element of the fuel flap is a pulse width modulated signal. In some embodiments, the control signal 19 that is directed to the control element of the fuel flap is a signal from a converter.

In some embodiments, the burner appliance 1 comprises a converter and the control signal 19 that is directed to the control element of the fuel flap is a signal from the converter of the burner appliance 1.

In some embodiments, the regulating and/or controlling and/or monitoring facility 13 is communicatively connected to the control element of the fuel flap.

In some embodiments, the at least one fuel actuator 9 comprises as a control element a controlled valve or a valve that is regulated internally by way of a through-flow sensor and said fuel actuator is configured to receive a control signal 19, which is directed to the control element, and with the aid of the control element to adjust the position of said valve according to the control signal 19 and consequently to adjust the fuel supply $\dot{V}_B$; and the step of ascertaining the at least one fuel supply signal 17-19 that is a measurement for a value of a fuel supply $\dot{V}_B$ through the fuel supply duct 6, said value being adjusted with the aid of the at least one fuel actuator 9, comprises ascertaining at least one control signal 19 that is directed to the valve that is controlled or is internally regulated by way of a through-flow sensor, said control signal being a measurement for a fuel supply $\dot{V}_B$, said value being adjusted with the aid of the at least one fuel actuator 9.

In some embodiments, the regulating and/or controlling and/or monitoring facility 13 is communicatively connected to the valve that as the fuel actuator 9 is controlled or internally regulated by way of a through-flow sensor, the method further comprises ascertaining by the regulating and/or controlling and/or monitoring facility 13 at least one control signal 19 that is directed to the valve that as the fuel actuator 9 is controlled or is internally regulated by way of a through-flow sensor, said control signal being a measurement for a fuel supply $\dot{V}_B$, said value being adjusted with the aid of the at least one fuel actuator 9.

In some embodiments, the regulating and/or controlling and/or monitoring facility 13 is communicatively connected to a valve that as the fuel actuator 9 is internally regulated by way of a through-flow sensor, and the method further comprises transmitting the actual value of the fuel supply $\dot{V}_B$ from the fuel actuator 9 to the regulating and/or controlling and/or monitoring facility 13.

In some embodiments, the regulating and/or controlling and/or monitoring facility 13 has a steady state, and the method further comprises using the actual value of the fuel supply $\dot{V}_B$ that is transmitted to the regulating and/or controlling and/or monitoring facility 13 in lieu of the target value for the fuel supply $\dot{V}_B$ by the regulating and/or controlling and/or monitoring facility 13 in the steady state.

The regulating and/or controlling and/or monitoring facility 13 generates in the steady state one or more signals at the at least one actuator 3, 4, 9, wherein the one or the multiple signals at the at least one actuator 3, 4, 9 practically do not oscillate. The regulating and/or controlling and/or monitoring facility 13 generates in the steady state one or more signals at the at least one actuator 3, 4, 9, wherein the one or the multiple signals at the at least one actuator 3, 4, 9 ideally do not oscillate.

In some embodiments, the method further comprises controlling the burner appliance 1 on the basis of the allocation of a fuel group from the comparison of the calculated minimum air requirement 22 with the minimum air requirement of the at least one characteristic value 31, 32 that is stored in the memory of the regulating and/or controlling and/or monitoring facility 13.

In some embodiments, the memory of the regulating and/or controlling and/or monitoring facility 13 is non-volatile.

In some embodiments, the burner appliance 1 comprises at least one analogue-digital converter; and the step of processing the at least one air ratio signal 21 to a value of an air ratio $\lambda$ comprises processing the at least one air ratio signal 21 to a value of an air ratio $\lambda$ by the at least one analogue-digital converter.

In some embodiments, the burner appliance 1 comprises at least one analogue-digital converter; and the step of processing the at least one air supply signal 14-16 to a value of an air supply $\dot{V}_L$ comprises processing the at least one air supply signal 14-16 to a value of an air supply $\dot{V}_L$ by the at least one analogue-digital converter.

In some embodiments, the burner appliance 1 comprises at least one analogue-digital converter; and the step of processing the at least one fuel supply signal 19 to a value of a fuel supply $\dot{V}_B$ comprises processing the at least one fuel supply signal 19 to a value of a fuel supply $\dot{V}_B$ by the at least one analogue-digital converter.

In some embodiments, the burner appliance 1 comprises at least one analogue-digital converter; and the at least one analogue-digital converter is communicatively connected to the regulating and/or controlling and/or monitoring facility 13.

In some embodiments, the burner appliance 1 comprises at least one analogue-digital converter; and the at least one analogue-digital converter is integrated in the regulating and/or controlling and/or monitoring facility 13.

In some embodiments, the regulating and/or controlling and/or monitoring facility 13 and the analogue-digital converter can be arranged jointly on a one-chip system. The U.S. Pat. No. 9,148,163B2 for example teaches such a system.

In some embodiments, the regulating and/or controlling and/or monitoring facility 13 comprises a processing unit, for example a processor and/or micro-controller and/or microprocessor.

In some embodiments, the burner appliance 1 comprises a combustion chamber 2, a regulating and/or controlling and/or monitoring facility 13 comprising a memory in which is stored at least one characteristic value 31, 32 comprising a minimum air requirement, at least one air ratio sensor 20, an air supply duct 11 that leads directly to the combustion chamber 2 and comprises at least one air actuator 3, 4 that is configured to adjust a value of an air supply $\dot{V}_L$ through the air supply duct 11, and a fuel supply duct 6 that preferably leads directly to the combustion chamber 2 and comprises at least one fuel actuator 9 that is configured to adjust a value of a fuel supply $\dot{V}_B$ through the fuel supply duct 6, wherein the regulating and/or controlling and/or monitoring facility 13 is communicatively connected to the at least one air actuator 3, 4, the at least one fuel actuator 9 and the at least one air ratio sensor 20; and the regulating and/or controlling and/or monitoring facility 13 is configured to perform the steps of the previously mentioned methods.

In some embodiments, there is a computer program product and/or a computer program comprising commands that cause one of the previously mentioned burner facilities 1 to perform one of the previously mentioned methods.

In some embodiments, there is a computer-readable medium on which is stored the previously mentioned computer program.

In some embodiments, there is a non-volatile computer-readable memory storage medium that stores a set of commands for implementation by at least one processor that performs one of the previously mentioned methods if the set of commands is implemented by a processor.

In some embodiments, there is a regulating and/or controlling and/or monitoring facility 13 for a burner appliance 1, wherein the regulating and/or controlling and/or monitoring facility 13 is configured to perform one of the previously mentioned methods.

In some embodiments, there is a regulating and/or controlling and/or monitoring facility 13 of a burner appliance 1, wherein the regulating and/or controlling and/or monitoring facility 13 is configured to perform one of the previously mentioned methods.

In some embodiments, the air ratio λ is or comprises a combustion air ratio. Thus, for a fuel, the air ratio λ is or comprises the ratio of the (actual) supplied air to the minimum air requirement. In particular, for a fuel, the air ratio λ is or comprises the ratio of the air supply $\dot{V}_L$ to the minimum air requirement $L_{min}$.

The above relates to individual embodiments of the disclosure. Various changes to the embodiments can be made without deviating from the fundamental idea and without abandoning the scope of this disclosure. The subject matter of the present disclosure is defined by way of its claims. The most varied changes can be made without abandoning the protective scope of the following claims.

REFERENCE NUMERALS

1: Burner appliance
2: Combustion chamber
3: Blower having an (optional) variable rotational speed
4: Air flap with control drive
5: Combustion air
6: Fuel for combustion or fuel supply duct
7: Safety shut-off valve
8: Safety shut-off valve
9: Fuel actuator having a control drive for changing the fuel supply
10: Exhaust gas
11: Air supply duct
12: Sensor for ascertaining the air supply (air mass flow/rotational speed etc.)
13: Regulating and/or controlling and/or monitoring facility
14: Control signal for air flap (actuating angle)
15: Control signal for the blower rotational speed (optional)
16: Measurement signal from the air supply sensor
17: Open/close signal for the safety shut-off valve
18: Open/close signal for the safety shut-off valve
19: Control signal for the fuel actuator (for example actuating angle/step position)
20: Sensor for ascertaining the air ratio λ ($O_2$ sensor/ionization electrode etc.)
21: Measurement signal from the air ratio sensor for ascertaining the air ratio
22: Minimum air requirement for the respective fuel
23: Individual scalar fuel parameter $h=H_U/L_{min}$
24: Various gases of the second gas family including special gases (gas mixtures with methane as the base gas)
25: Specific special gas of the second gas family (in this case propane-air mixture)
26: Various gases of the third gas family (propane mixtures)
27: Specific special gas of the first gas family
28: Specific special gas of the first gas family
29: Specific special gas of the first gas family
30: Hydrogen and methane-hydrogen mixtures
31: Limit value of the minimum air requirement $L_{min}$ of the gases between the second and the third gas family
32: Limit value of the minimum air requirement $L_{min}$ of the gases between the second gas family and methane-hydrogen mixtures

The invention claimed is:

1. A method for regulating a burner appliance comprising a combustion chamber, an air supply duct leading to the combustion chamber with an air actuator configured to adjust a value of an air supply V'_L through the air supply duct, and a fuel supply duct leading to the combustion chamber with a fuel actuator configured to adjust a value of a fuel supply V'_B through the fuel supply duct, the method comprising:

determining the value of the air supply V'_L;

determining a value of the air ratio λ;

providing an individual scalar fuel parameter h;

calculating an actual value of a power output P_ist of the burner appliance based on the value of the air supply V'_L, the value of the air ratio λ, and the individual scalar fuel parameter h using P_ist=h/λ·V'_L; and regulating the burner appliance with the fuel actuator and the air actuator based on the actual value P_ist and a target value P_soll of the power output until the actual value reaches the target value.

2. The method for regulating a burner appliance as claimed in claim 1, the method further comprising:

ascertaining an air ratio signal using an air ratio sensor in the combustion chamber; and processing the air ratio signal to determine the measured value of the air ratio.

3. The method for regulating a burner appliance as claimed in claim 1, the method further comprising:

ascertaining an air ratio signal using an air ratio sensor in an exhaust gas duct of the burner appliance; and processing the air ratio signal to determine the measured value of the air ratio.

4. The method for regulating a burner appliance according in claim 1, the method further comprising:

ascertaining an air supply signal using an air supply sensor; and processing the air supply signal to determine the measured value of the air supply V'_L.

5. The method for regulating a burner appliance according to claim 1, the method further comprising:

transmitting an air actuator signal to the air actuator;

adjusting the value of an air supply V'_L through the air supply duct with the air actuator as a function of the air actuator signal; and determining a value of the air supply V'_L through the air supply duct as a function of the air actuator signal and/or as a function of a rotational speed reported back.

6. The method for regulating a burner appliance according to claim 1, wherein:

the burner appliance comprises a mass flow sensor arranged in the air supply duct or in fluid connection with the air supply duct;

ascertaining the air supply signal as a measurement for the value of the air supply V'_L through the air supply duct to the combustion chamber comprises:

ascertaining a signal from a mass flow sensor corresponding to a value of the air supply V'_L through the air supply duct; and processing the air supply signal to determine the measured value of the air supply V'_L.

7. The method for regulating a burner appliance according to claim 1, the method further comprising:

calculating a ratio h/λ of the individual scalar fuel parameter h and the value of the air ratio λ; and calculating the actual value P_ist as a function of the calculated ratio h/λ and the value of the air supply V'_L.

8. The method for regulating a burner appliance as claimed in claim 7, further comprising calculating the actual value P_ist by multiplying the calculated ratio h/λ by the value of the air supply V'_L.

9. The method for regulating a burner appliance (1) according to claim 7, the method further comprising:

providing the individual scalar fuel parameter h as energy of a fuel per air volume and/or per air mass and/or per amount of substance of the air supply V'_L in the case of stoichiometric portions of the fuel supply V'_B and air supply V'_L; and calculating the ratio h/λ from the provided individual scalar fuel parameter h and the value of the air ratio λ.

10. The method for regulating a burner appliance as claimed in claim 1, the method further comprising:

ascertaining an air ratio signal using an air ratio sensor and processing the air ratio signal to determine a value of the air ratio λ;

ascertaining an air supply signal for a value of the air supply V'_L and processing the air supply signal to determine the value of the air supply V'_L;

ascertaining the fuel supply signal for a value of a fuel supply V'_B, and processing the fuel supply signal to determine the value of the fuel supply V'_B;

calculating a minimum air requirement as a function of the value of the air supply V'_L and the value of the fuel supply V'_B and the value of the air ratio λ;

comparing the calculated minimum air requirement with the minimum air requirement of the characteristic value stored in the memory of the regulating and/or controlling and/or monitoring facility;

allocating a fuel group from the comparison; and providing the individual scalar fuel parameter h as a function of the allocated fuel group.

11. The method as claimed in claim 10, wherein the air supply duct (11) leads directly to the combustion chamber (2) and the fuel supply duct (6) leads directly to the combustion chamber (2), the method further comprising:

ascertaining the air supply signal for a value of the air supply V'_L directly to the combustion chamber, and processing the air supply signal to determine the value of the air supply V'_L; and ascertaining the fuel supply signal for a value of a fuel supply V'_B directly to the combustion chamber, and processing the fuel supply signal to determine the value of the fuel supply V'_B.

12. The method as claimed in claim 10, wherein the air supply duct and the fuel supply duct issue upstream of the combustion chamber into a common mixture feed leading to the combustion chamber, the method further comprising:

ascertaining the air supply signal for the value of the air supply V'_L to the common mixture feed, and processing the air supply signal to determine a value of the air supply V'_L; and ascertaining the fuel supply signal for the value of the fuel supply V'_B to the common mixture feed, and processing the fuel supply signal to determine the value of the fuel supply V'_B.

13. The method according to claim 10, wherein:

the characteristic value stored in the memory of the regulating and/or controlling and/or monitoring facility comprises the minimum air requirement in the form of a limit value for the minimum air requirement of a first and a second fuel group from one another; and the method further comprises allocating the calculated minimum air requirement to the first or to the second fuel group with the aid of the limit value.

14. The method according to claim 10, wherein calculating the minimum air requirement as a function of the value of the air supply V'_L and as a function of the value of the fuel supply V'_B and as a function of the value of the air ratio λ comprises calculating the minimum air requirement as a quotient from the value of the air supply V'_L and a product from the value of the fuel supply V'_B and from the value of the air ratio λ.

15. A non-transitory computer-readable memory storage medium storing a set of commands for implementation by a regulating and/or controlling and/or monitoring facility for a burner appliance comprising a combustion chamber, a fuel supply duct leading to the combustion chamber with a fuel actuator configured to adjust a value of a fuel supply V'_B through the fuel supply duct, and an air supply duct leading to the combustion chamber with an air actuator configured to adjust a value of an air supply V'_L through the air supply duct, the set of commands causing the regulating and/or controlling and/or monitoring facility to:

determine the value of the air supply V'_L;

determine a value of the air ratio λ;

provide an individual scalar fuel parameter h;

calculate an actual value P_ist of a power output of the burner appliance from the value of the air supply V'_L, the value of the air ratio λ, and the individual scalar fuel parameter h in accordance with P_ist=h/λ·V'_L; and regulate the burner appliance with the fuel actuator and the air actuator based on the actual value P_ist of the power output and a target value P_soll of the power output of the burner appliance until the actual value reaches the target value.

* * * * *